US009404484B2

(12) United States Patent
Pilcher et al.

(10) Patent No.: US 9,404,484 B2
(45) Date of Patent: Aug. 2, 2016

(54) DIAPHRAGM PUMP AND VALVE ASSEMBLY WITH MOLDED WOBBLE PLATE

(75) Inventors: Matthew Robert Pilcher, Owatonna, MN (US); Nicholas Allen Rancourt, Faribault, MN (US); Jim Hu, Ningbo (CN)

(73) Assignee: Northern Tool & Equipment Company, Inc., Burnsville, MN (US)

( * ) Notice: Subject to any disclaimer, the term of this patent is extended or adjusted under 35 U.S.C. 154(b) by 327 days.

(21) Appl. No.: 13/491,499

(22) Filed: Jun. 7, 2012

(65) Prior Publication Data

US 2013/0330213 A1 Dec. 12, 2013

(51) Int. Cl.
*F04B 27/08* (2006.01)
*F04B 43/02* (2006.01)

(52) U.S. Cl.
CPC ..... *F04B 27/08* (2013.01); *F04B 43/02* (2013.01)

(58) Field of Classification Search
CPC ..... F04B 53/1092; F04B 39/1073; F04B 27/109; F04B 27/08; F04B 43/02
USPC ..... 417/269, 560, 566, 571; 92/71; 384/537, 559, 584, 585, 536, 582
See application file for complete search history.

(56) References Cited

U.S. PATENT DOCUMENTS 3,062,346 A * 11/1962 Sharpe ..... D06F 37/36 192/48.5
4,611,933 A * 9/1986 Hofmann et al. ..... 384/512
4,801,249 A 1/1989 Kakizawa
4,822,111 A * 4/1989 Albert ..... B60B 3/002 301/105.1
5,887,982 A * 3/1999 Wilcher ..... F16C 35/02 384/247
6,357,336 B1 * 3/2002 Wittmann ..... F16C 19/54 74/60
6,840,745 B1 * 1/2005 Macauley ..... F04B 43/026 137/512.15
2006/0073036 A1 * 4/2006 Pascual ..... F04B 43/0054 417/413.1
2008/0003120 A1 * 1/2008 Meza ..... F04B 43/026 417/413.1
2008/0226480 A1 * 9/2008 Ferran ..... F04C 18/22 418/5
2010/0008775 A1 1/2010 Vedsted et al.
2012/0328224 A1 * 12/2012 Lee ..... F16C 17/02 384/397

FOREIGN PATENT DOCUMENTS

EP 0713009 A2 5/1996
GB 929886 A * 6/1963 ..... F16C 11/0633
JP 2004-232470 A 8/2004

OTHER PUBLICATIONS

Definition of Dimple.*
Insert Molding.*
PCT Notification of Transmittal of the International Search Report and the Written Opinion of the International Searching Authority, or the Declaration, Cited in PCT/US2012/041394, Dated Feb. 21, 2013, 3 Pgs.
PCT Search Report for PCT Application No. PCT/US2012/041394, dated Dec. 18, 2014.

* cited by examiner

*Primary Examiner* — Justin Jonaitis
*Assistant Examiner* — Christopher Brunjes
(74) *Attorney, Agent, or Firm* — Patterson Thuente Pedersen, P.A.

(57) ABSTRACT

A diaphragm pump having an improved wobble plate and cam/bearing assembly for increased pump life and improved inlet and outlet valve design for increased effective sealing area. A cam/bearing assembly includes a cam injection molded directly into an inner race of a bearing to prevent the cam from pulling away from the bearing. The wobble plate is injection molded directly onto an outer race of the bearing to prevent the wobble plate from pulling away from the cam and bearing. Inlet and outlet check valves include rounded peripheral relief zones that form a band, as opposed to a line, of effective sealing area when in the sealed position within a valve seat that eliminate or reduce sealing inconsistencies and increase sealing efficiencies.

19 Claims, 23 Drawing Sheets

DIAPHRAGM PUMP AND VALVE ASSEMBLY WITH MOLDED WOBBLE PLATE

FIELD OF THE INVENTION

The invention relates generally to diaphragm pumps, and more particular to improved cam/bearing assemblies, improved wobble plate/bearing assemblies, and improved valve assemblies for diaphragm pumps.

BACKGROUND OF THE INVENTION

Reciprocating pumps are those which cause the fluid to move using one or more oscillating pistons, plungers or membranes (diaphragms), and restrict motion of the fluid to the one desired direction by check valves. One type of reciprocating pump is a diaphragm pump. A diaphragm pump is a positive displacement pump that uses a combination of the reciprocating action of a diaphragm, such as a rubber diaphragm, a wobble plate for driving each of a series of pistons formed in the diaphragm, a series of chambers formed on a valve housing for receiving piston structures of the diaphragm, and suitable non-return check valves coupled to the valve housing to ultimately pump a fluid from an inlet port to an outlet port.

Diaphragm pumps are commonly used to move relatively small amounts of fluid, such as water from one location to another. Diaphragm pumps can be used, for example to move water into and out of a recreational vehicle, on property, and the like. Typical flow rates for diaphragm pumps are up to ten gallons per minute (GPM) for commercial applications, although diaphragm pumps with greater flow capacities are available for industrial applications.

Diaphragm pumps are often driven by motors, gas-powered or electric motors including a drive shaft. A cam and ball bearing assembly interposed between the drive shaft and a wobble plate convert the rotational movement of the drive shaft to the push-pull motion of a series of pistons through the wobble plate. The wobble plate is mechanically coupled to the diaphragm. A nutating action of the diaphragm and wobble plate acts to actuate each piston sequentially into each chamber of the series of chamber defined on the valve plate to push and pull fluid into and out of each chamber.

Diaphragm pumps are typically single-acting in which suction during one direction of piston motion pulls fluid from in inlet chamber into a chamber of the valve plate, and during the other direction of the piston motion discharges the fluid from the chamber into an outlet chamber. More specifically, when the volume of a chamber of valve plate is increased (i.e. the piston moving out of or away from the chamber), the pressure in the chamber decreases, and fluid is drawn into the chamber from the inlet chamber in fluid communication with the inlet port to the pump. When the chamber pressure later increases from decreased volume (the piston moving into or down the chamber), the fluid previously drawn into the chamber is forced out of the chamber into an outlet chamber in fluid communication with an outlet port of the pump. Finally, the diaphragm moving up and out of the chamber once again draws fluid into the chamber, completing the cycle.

Examples of diaphragm pumps are described in, for example, U.S. Pat. Nos. 5,791,882, 6,048,183, 6,623,245, and 6,840,745 all of which are incorporated herein by reference in their entireties.

As discussed above, the wobble plate is operably coupled to the rotating drive shaft of a motor via the cam/bearing assembly. More particularly, the cam is coupled the drive shaft at an inner surface of the cam such that the cam does not rotate with respect to the shaft, but rather with the shaft. The cam also includes an outer annular surface coupled to an inner race of the ball bearing such that the cam does not rotate relative to the inner race of the ball bearing. The wobble plate is coupled to an outer race of the ball bearing such that the wobble plate surrounds the cam/bearing assembly, and the wobble plate does not rotate with respect to the outer race of the ball bearing.

During pump operation, particularly continuous duty operation, heat is generated from internal friction in the bearing as well as radiant heat from the motor. The generated heat causes the connections between the cam and bearing, and the wobble plate and bearing to become loose due to different expansion rates of the materials forming each of the cam, bearing, and wobble plates. When the connections become loose, flow performance suffers, such that flow can be reduced in excess of 50% of its capability. More heat from friction is generated after the connections become loose, accelerating the performance decrease and ultimately causing the bearing to fail.

Another common mode of failure of either the connections between the cam and bearing or the bearing and wobble plate are caused from the offset positioning of the cam on the drive shaft of the motor. The nutating action then places excessive load on the wobble plate which can dislocate the wobble plate from the bearing and/or the cam. Harmonic oscillations created due to the offset nature of the wobble plate can also cause the bearings to come loose. Similar to above, when the connections become loose, flow performance suffers, such that flow can be reduced in excess of 50% of its capability.

One technique for lengthening the durability of a cam/bearing connection 1 and referring to FIG. 1, is to press fit a cam 10 made of cast zinc allow into an inner race 14 of a bearing 12 forming an interference fit. Cam 10 can be staked into place for further durability by punching dimples 16 into a face 18 of cam 10 as shown in FIG. 1, thus deforming cam 10 to help hold it into bearing 12. Although staking cam 10 into bearing 12 has improved the durability of the connection, failures are still seen after long continuous duty operation.

Regarding a wobble plate/bearing connection 20 as shown in FIG. 2, during assembly, a wobble plate 22 made of cast aluminum alloy is heated to 140 degrees Celsius and bearing 12 is pressed into wobble plate 22. Because wobble plate 22 is machined to tight tolerances, after wobble plate 22 cools and shrinks, there is a tight interference fit between an outer race 28 of bearing 12 and wobble plate 22. Wobble plate 22 is then staked at 24 to further secure bearing 12 to wobble plate 22 as shown in FIG. 2. Further, a plurality of set screws 26 are installed to hold outer race 28 of bearing 12 from rotating inside wobble plate 22. This technique has greatly reduced or even completely eliminated the loose connection condition between the wobble plate and bearing even after 1000+ hours of continuous duty operation. However, this technique is both expensive and time consuming during assembly.

Regarding the check valve and valve housing assembly, inlet and outlet valves positioned on and carried by the valve housing typically found in diaphragm pumps have problems of inconsistent sealing, thereby further reducing the pump operation efficiency.

Referring to FIGS. 3A-4B, a prior art inlet valve 30 includes a central mounting section 32, such as a post, and a resilient, seal-forming section 34 surrounding an end 36 of post 32. Central mounting section 32 acts to secure inlet valve 30 within a valve seat 38 of a chamber of the valve housing. Resilient section 34 includes a center section 40 and a peripheral relief zone 42 or lip. Peripheral relief zone 42 acts to form a seal when slightly flexed within valve seat 38 of the valve housing, thereby sealing and restricting fluid communication through the inlet apertures.

Referring to FIGS. 4A-4C, prior art valve is depicted being mounted in a valve seat of a chamber of the valve housing. Referring to FIG. 4A, a first side 44 of peripheral relief zone 42 is shown in the relaxed position, i.e. how the valve naturally lies prior to being assembled within the valve seat, while a second side 46 is shown in a slightly flexed, sealed position, i.e. when the piston of the diaphragm is moving into the chamber in which the inlet valve is mounted such that fluid flow is restricted or completely prevented. As shown in FIG. 4C, a first side 44 of peripheral relief zone 42 is again shown in the relaxed position, i.e. how the valve naturally lies prior to being assembled within the valve seat, while a second side 47 is shown in a flexed, or opened position, such that peripheral relief zone 42 is significantly flexed or lifted out of the seat to allow fluid flow. As shown in FIG. 4A, a cross-section of the peripheral relief zone comprises a stepped portion or a mathematical profile represented by a discrete or discontinuous function. However, this "stepped" design provides minimal flexural relief in that it only seals along an edge of lip 42, such that an effective sealing area 48 of valve 30 is limited to a thin line (as seen on side 46), creating sealing inconsistencies.

Referring to FIGS. 5A-6B, a prior art outlet valve 50 includes a central mounting section 52, such as a post, and a resilient, seal-forming section 54 surrounding an end of post 52. Central mounting section 52 acts to secure outlet valve 50 within a valve seat 56 on an exterior side of the valve housing such that outlet valve 50 extends between two chambers of the valve housing. Resilient section 54 includes a center section 58 and a peripheral relief zone or lip 60. Peripheral relief zone 60 acts to form a seal within the valve housing, thereby sealing and restricting fluid communication from a chamber through the outlet apertures, i.e. when a piston of the diaphragm is moving out of the chamber.

Referring to FIGS. 6A and 6B, prior art outlet valve 50 is depicted being mounted in a valve seat 56 on an exterior of the valve housing such that outlet valve covers outlet apertures of a chamber of the valve housing. A first side 62 of peripheral relief zone 60 is shown in the relaxed position, i.e. how the valve naturally lies prior to being assembled within the valve seat, while a second side 64 is shown in a slightly flexed, sealed position, i.e. such that fluid flow is restricted or completely prevented. This is when the piston of the diaphragm is moving out of the chamber to which outlet valve 50 is mounted. The valve is in an open position when peripheral relief zone 60 is significantly flexed or lifted out of the seat to allow fluid flow. As shown in the figures, a cross-section of peripheral relief zone 60 comprises a stepped portion or a mathematical profile represented by a discrete or discontinuous function. However, this "stepped" design provides minimal flexural relief in that it only seals along an edge of lip 60, such that an effective sealing area 66 of valve 50 is limited to a thin line (as seen on side 64), creating sealing inconsistencies.

Furthermore, inconsistencies in the effective sealing area can be created during manufacturing the prior art valves. When molding the prior art valves, the molding die typically includes two halves. Where the two halves meet, there is the potential for flash, which is the material that is squeezed out at the parting line of the two halves. Referring to FIGS. 5B, 6B, this parting line 68, 70 is typically coextensive with the sealing edge of the lip of either the inlet valve or the outlet valve. This can cause an inconsistent sealing edge, and therefore an inconsistent seal.

In view of the issues of the prior diaphragm pumps, there remains a need for an improved cam/bearing assembly and an improved bearing/wobble plate assembly for improving the life and efficiency of the pump, without significantly increasing the time, complexity, and cost for manufacturing the pumps. Furthermore, there remains a need for an improved check valve design for improving the effective sealing characteristics of both inlet and outlet valves.

SUMMARY OF THE INVENTION

Embodiments of the invention are directed to an improved diaphragm pump including an improved wobble plate and bearing assembly, an improved cam and bearing assembly, and an improved valve assembly, for increasing the pump reliability, life, and efficiency. In embodiments of the invention, an improved cam and bearing assembly includes a cam injection molded directly into an inner race of a bearing to prevent the cam from pulling away from the bearing. In additional embodiments of the invention, an improved wobble plate and bearing assembly includes a wobble plate injection molded directly onto an outer race of the bearing to prevent the wobble plate from pulling away from the cam and bearing assembly. In yet additional embodiments of the invention, improved inlet and/or outlet check valves include rounded peripheral relief zones that form a band, as opposed to a line, of effective sealing area when in the sealed position within a valve seat that eliminate or reduce sealing inconsistencies and increase sealing efficiencies.

In generally, a diaphragm pump according to embodiments of the invention can comprise a pump housing including a front cover and a back cover for housing the pump components. The front cover includes an inlet port, an inlet chamber in fluid communication with the inlet port, an outlet port, and an outlet chamber in fluid communication with the outlet port. The pump includes a motor assembly comprising a motor and a rotatable drive shaft, wherein the rotatable drive shaft extends through the back cover. A cam and bearing assembly is coupled to the drive shaft, and a wobble plate is secured to and fixed relative to an outer race of the bearing. The wobble plate includes a plurality of piston structures that correspond to piston structures of a diaphragm coupled to a face of the wobble plate having the piston structures thereon. The combination of the piston structures and the diaphragm form pistons.

A valve assembly is fixed relative to the diaphragm/wobble plate assembly via the housing and includes a plurality of chambers and a plurality of check valves, wherein each chamber is in selective fluid communication with each of the inlet chamber and the outlet chamber of the front cover. The check valves are shiftable between an open position in which the chamber is in fluid communication with one of the inlet chamber and the outlet chamber, and a closed, sealed position in which the chamber is not in fluid communication with one of the inlet and the outlet chamber.

The cam and bearing assembly are adapted to convert a rotating motion of the drive shaft to a nutating motion of the wobble plate, such that each piston engages a chamber of the valve assembly in sequential order, thereby forcing fluid into the chamber from the inlet chamber during an intake stroke, and out of the chamber into the outlet chamber during a discharge stroke, the strokes cycling in a reciprocating motion to create a pumping action of the fluid through the pump.

In one embodiment of the invention, an improved cam and bearing assembly includes a cam comprising an injected molded plastic cam secured within an inner race of the bearing, such that the cam is fixed relative to the inner race of the bearing, and wherein the cam is coupled to the drive shaft such that it is fixed relative to the drive shaft. An annular wall of the inner race of the bearing includes structure defining one or more notches, wherein the notches and an outer annular wall of the cam are engaged such that the cam is prevented from rotating with respect to the inner race of the bearing. Further, wherein an outer first face and an outer second face of the cam include an annular retaining lip, the annular retaining lip abutting a corresponding outer face of the inner race of the bearing, wherein the retaining lip prevents the cam from lateral movement with respect to the inner race of the bearing.

Additionally or alternatively, the wobble plate is injection molded over an outer race of the bearing such that the wobble plate is rotationally and laterally fixed relative to the outer race. In this embodiment, the outer race of the bearing includes structure defining one or more dimples, wherein an inner annular wall of the wobble plate and the dimples are engaged such that the wobble plate is prevented from rotating with respect to the outer race of the bearing.

A face of the inner race of the bearing optionally comprises structure defining sockets for positioning and releasably securing the cam and bearing assembly within a wobble plate mold for injection molding of the wobble plate. At least one of a first edge and a second edge of an inner annular wall of the wobble plate includes a retaining lip, and wherein the retaining lip abuts a corresponding outer face of the outer race of the bearing such that is wobble plate is laterally fixed with respect to the outer race of the bearing.

An improved wobble plate and bearing assembly according to embodiments of the invention includes a bearing presenting an outer race and an inner race, and a plastic wobble plate presenting a center ring for receiving a bearing within, and a plurality of piston structures extending radially from the center ring, wherein the wobble plate secured to the outer race of the bearing by injection molding such that the wobble plate is fixed in both lateral and rotational movement with respect to the outer race. The bearing includes structure defining one or more dimples, wherein an inner annular wall of the center ring of the wobble plate and the dimples are engaged such that the wobble plate is prevented from rotating with respect to the outer race of the bearing. A face of the inner race of the bearing comprises structure defining sockets for positioning and releasably securing the bearing within a wobble plate mold for injection molding of the wobble plate.

In one embodiment, at least one of a first edge and a second edge of an inner annular wall of the center ring of the wobble plate includes a retaining lip. The retaining lip abuts a corresponding outer face of the outer race of the bearing such that is wobble plate is laterally fixed with respect to the outer race of the bearing.

The wobble plate and bearing assembly further includes a cam comprising an injected molded plastic is secured within the inner race of the bearing, such that the cam is fixed in both lateral and rotational movement relative to the inner race of the bearing. An annular wall of the inner race of the bearing includes structure defining one or more notches, wherein the notches and an outer annular wall of the cam are engaged such that the cam is prevented from rotating with respect to the inner race of the bearing. Further, at least one of an outer first face and an outer second face of the cam include an annular retaining lip, the annular retaining lip abutting a corresponding outer face of the inner race of the bearing, wherein the retaining lip prevents the cam from lateral movement with respect to the inner race of the bearing.

According to some embodiments of the invention, a valve assembly for a diaphragm pump includes a valve housing presenting a first side and a second side, the first side including a plurality of chambers, wherein each chamber includes structure defining an inlet valve seat, plurality of inlet apertures, and a plurality of outlet apertures, and the second side including structure defining a plurality of outlet valve seats. An inlet valve is positioned within an inlet valve seat of each chamber of the plurality of chambers, such that the inlet valve selectively seals the plurality of inlet apertures of the chamber. An outlet valve is positioned in each outlet valve seat of the valve housing such that the outlet valve selectively seals the plurality of outlet apertures of one chamber.

Each of the inlet valves and the outlet valves include a mounting portion or post for mounting the valve in a corresponding valve seat, and a resilient portion surrounding an end of the mounting portion, the resilient portion being adapted for selectively sealing corresponding inlet or outlet apertures of a chamber. The resilient portion includes a center section and an outer sealing portion, wherein the outer sealing portion includes a rounded sealing surface such that an effective sealing area of the valve comprises a band, rather than the thin line formed by the prior art valves.

In one embodiment, valve housing comprises five chambers, and one inlet valve seat within each chamber. The second side of the valve housing comprises five outlet valve seats, and wherein each outlet valve seat overlaps a portion of two chambers.

Each inlet valve seat comprises structure defining a mounting aperture, and wherein the mounting portion of an inlet valve comprises a post, the post forming an interference fit with the mounting aperture to secure the inlet valve within the inlet valve. Each outlet valve seat comprises structure defining a valve mounting recess for receiving a post of an outlet valve. The outlet valve is secured radially (or laterally) by insertion of the post into the valve mounting recess of the outlet valve seat. The outlet valve is then additionally secured axially (or vertically) by a post extending from an inside surface of the outlet chamber of the top cover.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The embodiments of the present invention may be more completely understood in consideration of the following detailed description of various embodiments in connection with the accompanying drawings, in which.

Figure 1:
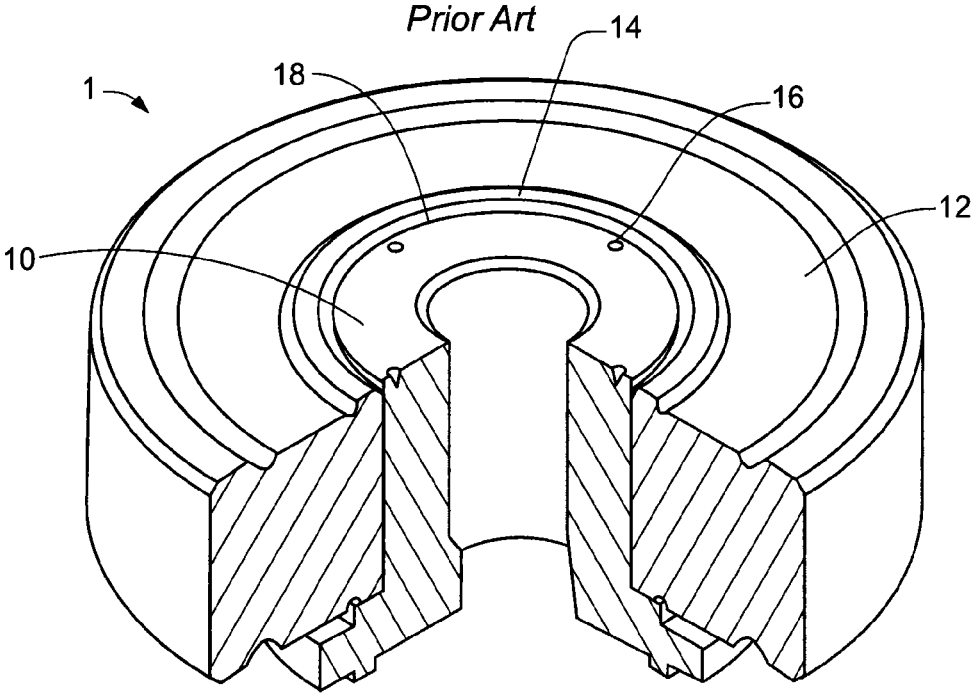
Fig. 1 Prior Art
FIG. 1 is a top perspective sectional view of a cam and bearing assembly according to the prior art.
Figure 2:
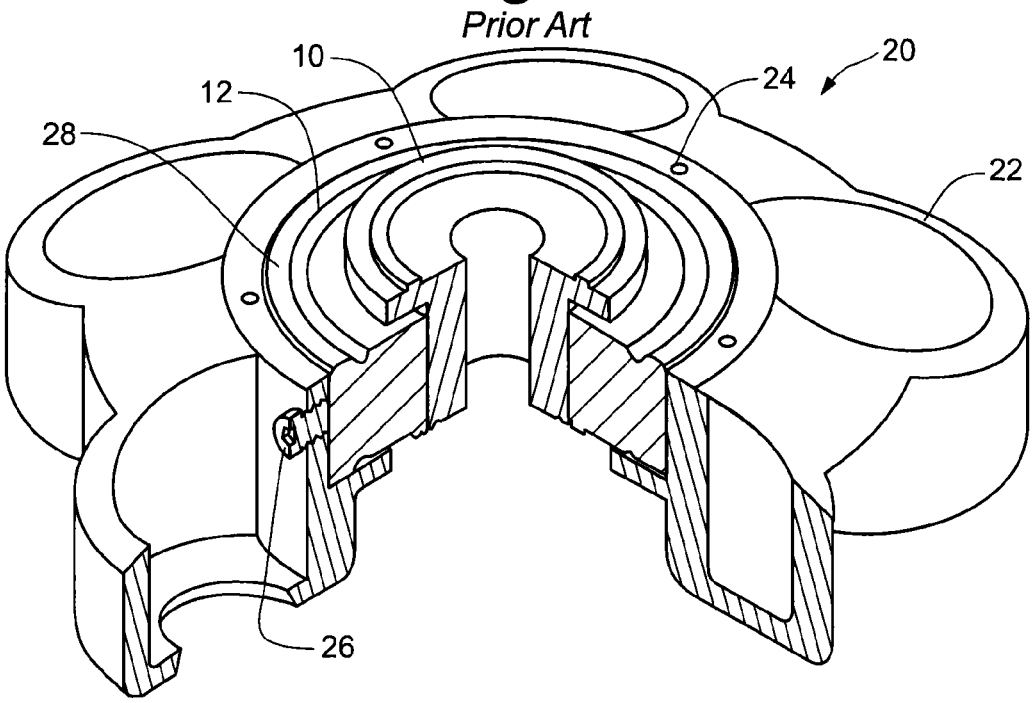
Fig. 2 Prior Art
FIG. 2 is a top perspective sectional view of a bearing and wobble plate assembly according to the prior art.
Figure 3A:
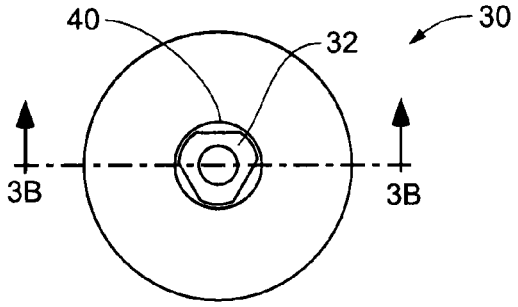
Fig. 3A Prior Art
FIG. 3A is a top view of an inlet valve according to the prior art.
Figure 3B:
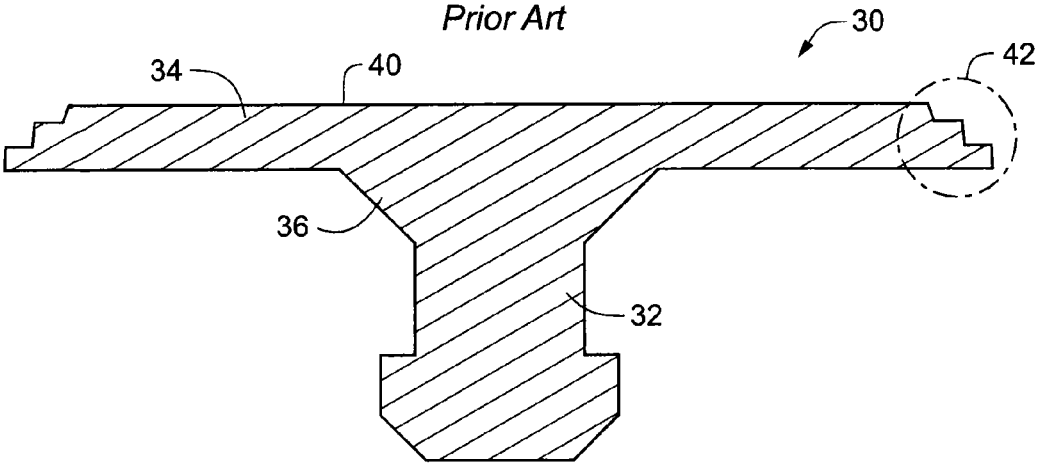
Fig. 3B Prior Art
FIG. 3B is a cross-sectional view taken at 3B-3B of FIG. 3A.
Figure 4A:
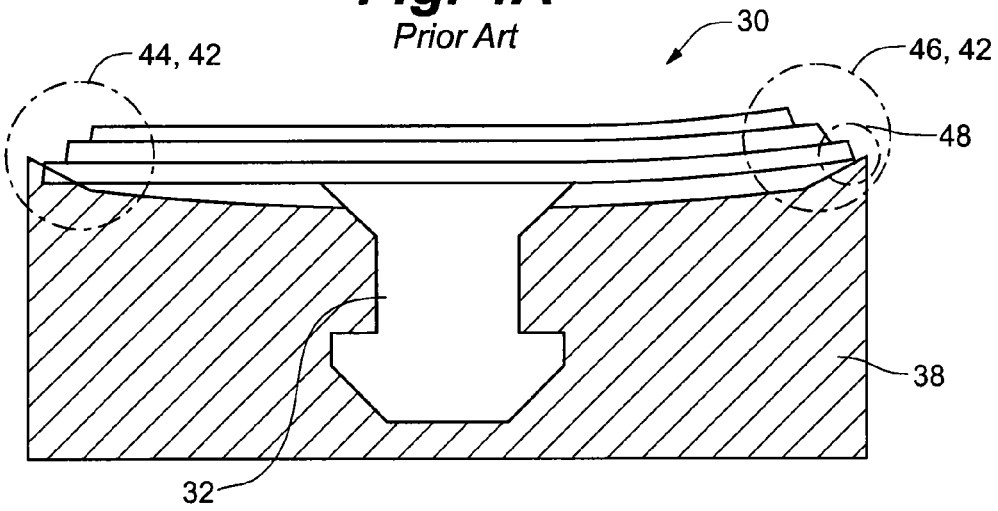
Fig. 4A Prior Art
FIG. 4A is a cross-sectional view of the inlet valve of FIG. 3B in a valve seat.
Figure 4B:
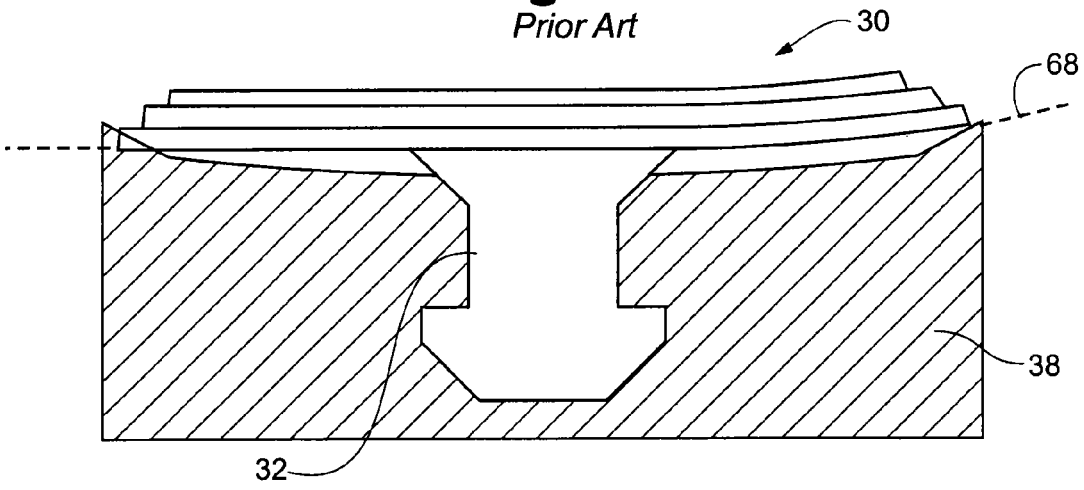
Fig. 4B Prior Art
FIG. 4B is a cross-sectional view of the inlet valve of FIG. 3B in a valve seat.
Figure 4C:
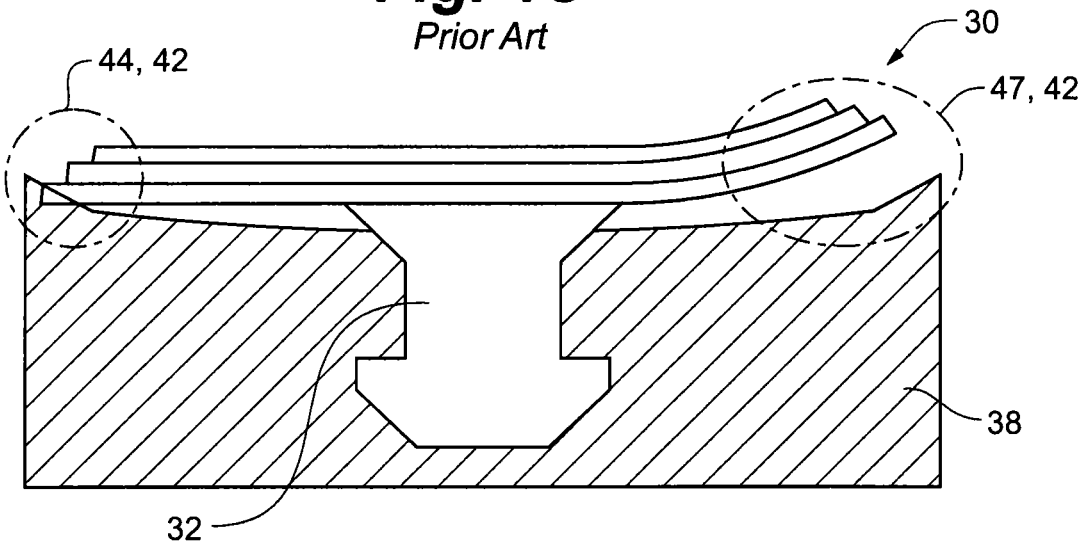
Fig. 4C Prior Art
FIG. 4C is a cross-sectional view of the inlet valve of FIG. 3B in a valve seat.
Figure 5A:
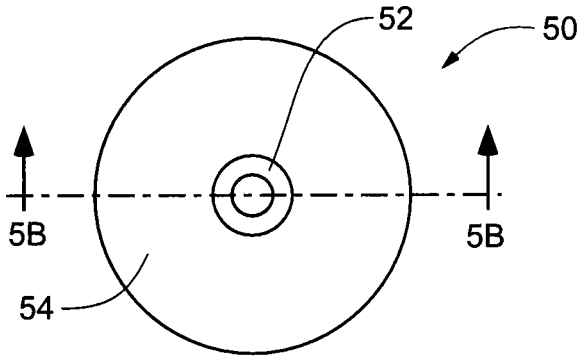
Fig. 5A Prior Art
FIG. 5A is a top view of an outlet valve according to the prior art.
Figure 5B:
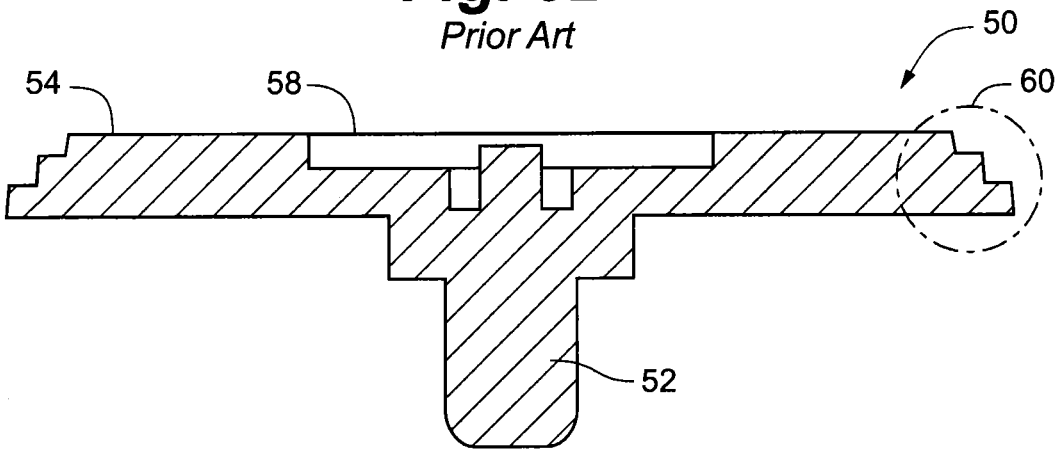
Fig. 5B Prior Art
FIG. 5B is a cross-sectional view taken at 5B-5B of FIG. 5A.
Figure 6A:
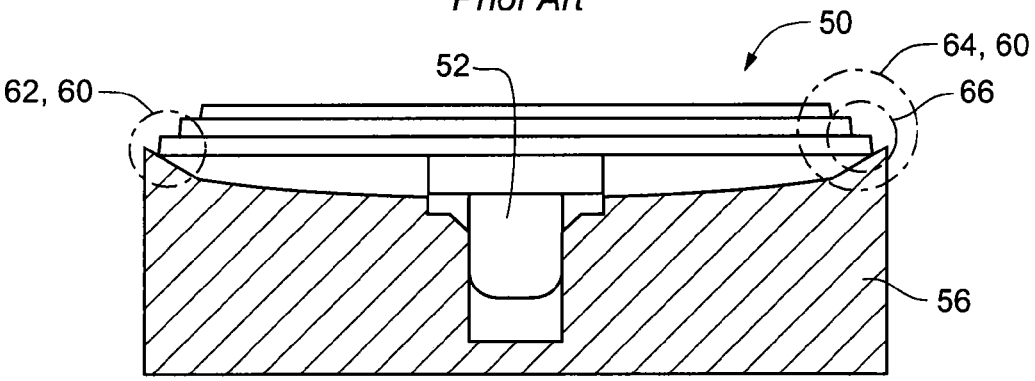
Fig. 6A Prior Art
FIG. 6A is a cross-sectional view of the outlet valve of FIG. 5B in a valve seat.
Figure 6B:
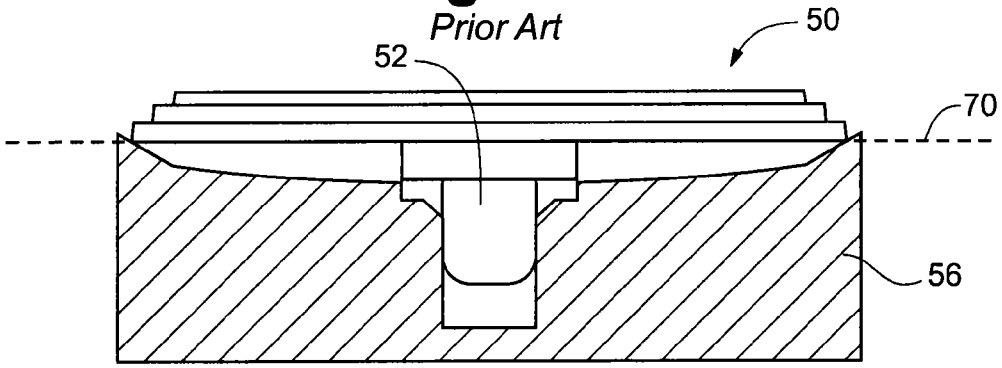
Fig. 6B Prior Art
FIG. 6B is a cross-sectional view of the outlet valve of FIG. 5B in a valve seat.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

Figure 7A:
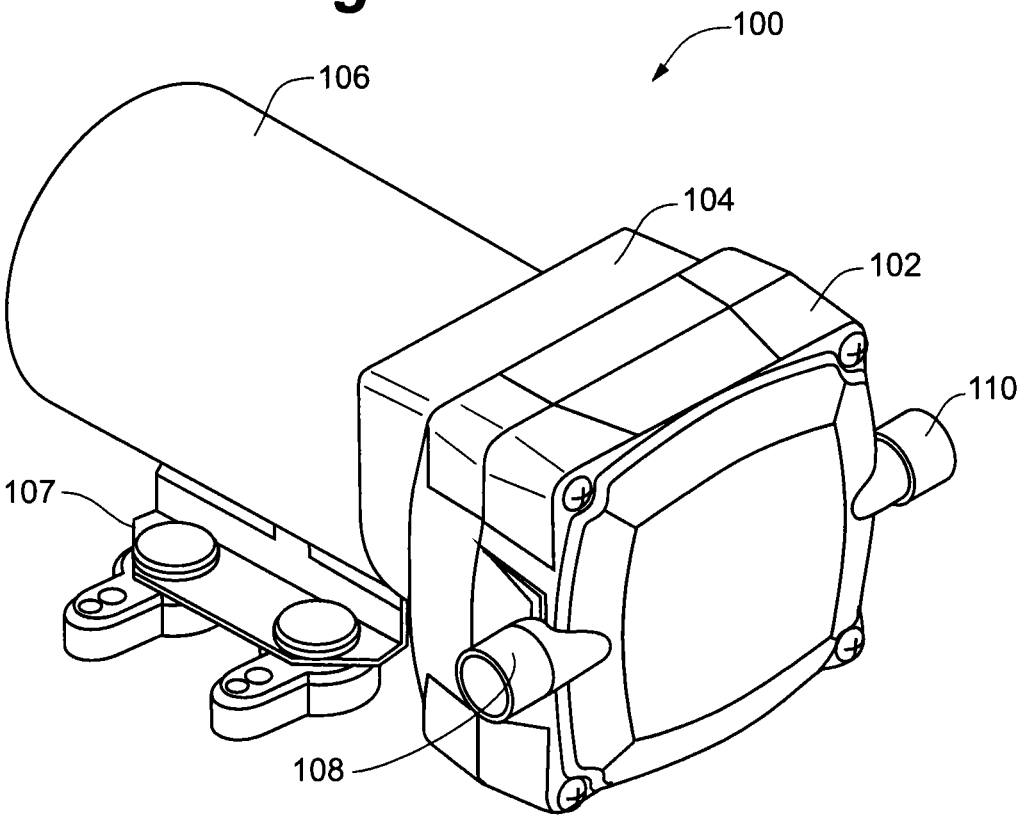
FIG. 7A is a diaphragm pump according to an embodiment of the invention.
Figure 7B:
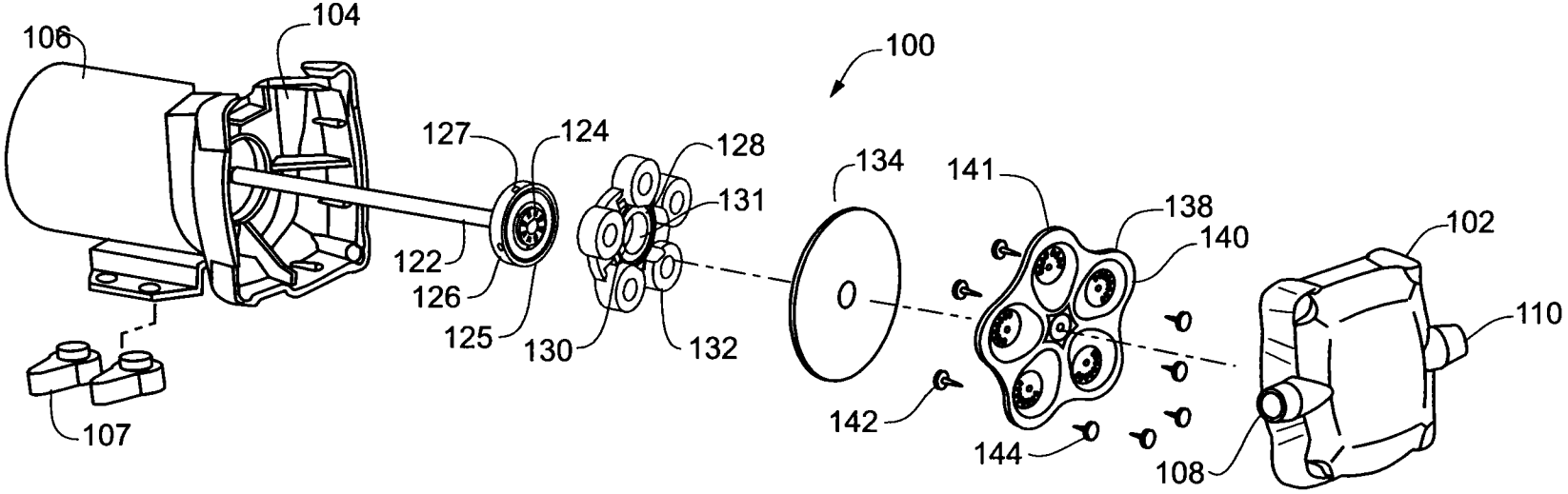
FIG. 7B is an exploded view of the diaphragm pump according to FIG. 7A.

Referring to FIGS. 7A-7B, a diaphragm pump 100 generally comprises a two part casing including a front cover 102 and a back cover 104, back cover 104 coupled to or housing a motor assembly 106. Optionally, diaphragm pump 100 can comprise a mounting mechanism 107, such as a pedestal, legs, or mounting bracket, for securing or positioning diaphragm pump 100 on a surface.

Figure 8:
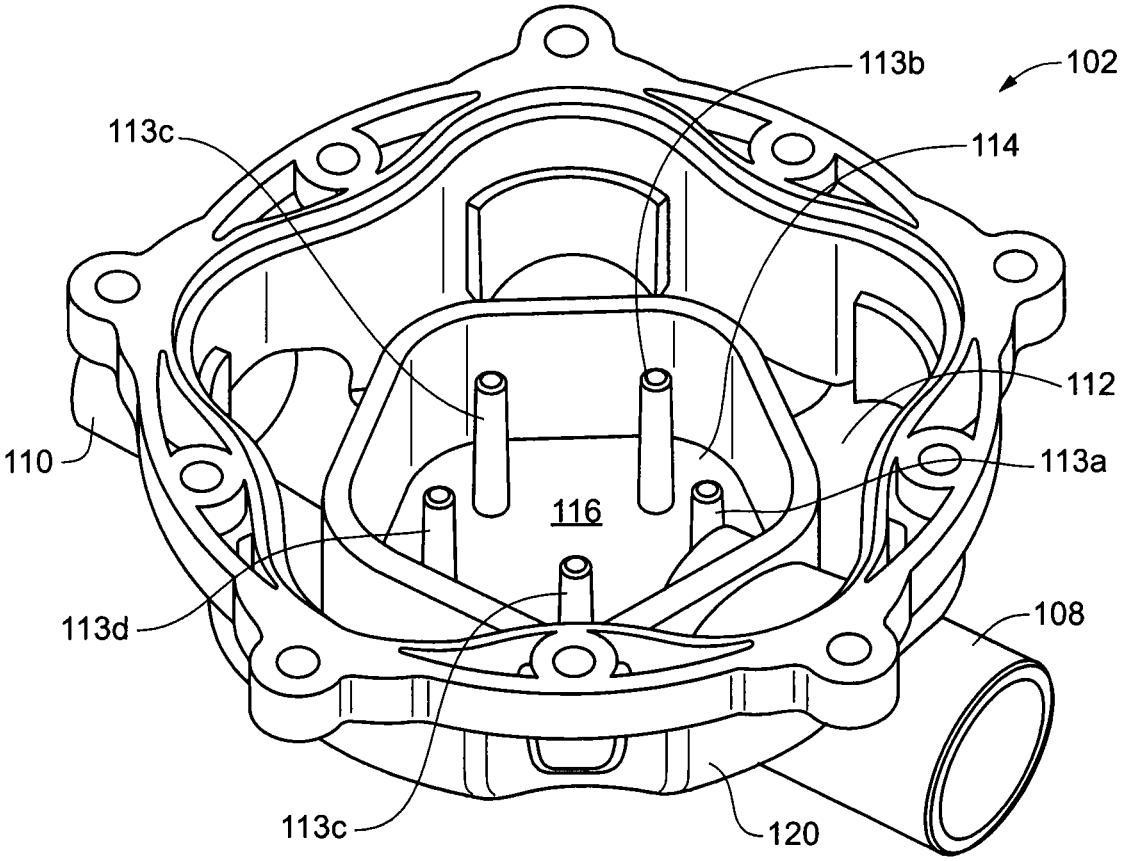
FIG. 8 is a top perspective view of an interior of a front cover of the diaphragm pump of FIG. 7A according to an embodiment of the invention.

Referring to FIG. 8, front cover 102 has an inlet port 108 and an outlet port 110. Inlet port 108 is connectable to an inlet fluid line (not shown) and outlet port 110 is connectable to an outlet fluid line (not shown). Inlet and outlet ports 108, 110 are each provided with fittings for connection to the inlet and outlet lines. Inlet port 108 and outlet port 110 each lead to a mutually exclusive inlet chamber 112 and outlet chamber 114. In one embodiment, an outlet chamber 114 is provided in a central area of front cover 102 and is defined by wall surround 118 in fluid communication with outlet port 110. Outlet chamber 114 further comprises an inner surface or floor 116, having one or more posts 113*a*-113*e* extending axially therefrom. Posts 113 are adapted to abut or press against an outer surface of outlet valves seated in a valve assembly positioned adjacent front cover 102, as described in more detail infra. Generally, the number and location of posts 113 correspond to the number and location of outlet valve seats of the valve assembly.

Inlet chamber 112 surrounds outlet chamber 114 and is defined space between wall surround 118 and a sidewall of front cover 102. Inlet chamber 112 is in fluid communication with inlet port 108. One of ordinary skill in the art would recognize that alternative configurations are possible so long as the inlet port 108 is in fluid communication with the inlet chamber 112, the outlet port 110 is in fluid communication with the outlet chamber 114, and the inlet chamber 112 is separate from the outlet chamber 114 such that the inlet chamber 112 and the outlet chamber 114 are not directly in fluid communication with one another.

Motor assembly 106 can comprise, for example, an electric motor (not shown) having a drive shaft 122 that extends through back cover 104. A cam 124 is coupled to drive shaft 122 of motor assembly 106, and does not rotate relative to drive shaft 122, but rather with drive shaft 122. Cam 124 is then coupled to a wobble plate 128 via a ball bearing 126. Specifically, cam 124 is coupled directly to an inner race 125 of bearing 126 such that the cam 124 is prevented from rotating relative to inner race 125 of bearing 126. A cam/bearing assembly 200 is discussed in more detail infra.

Figure 16:
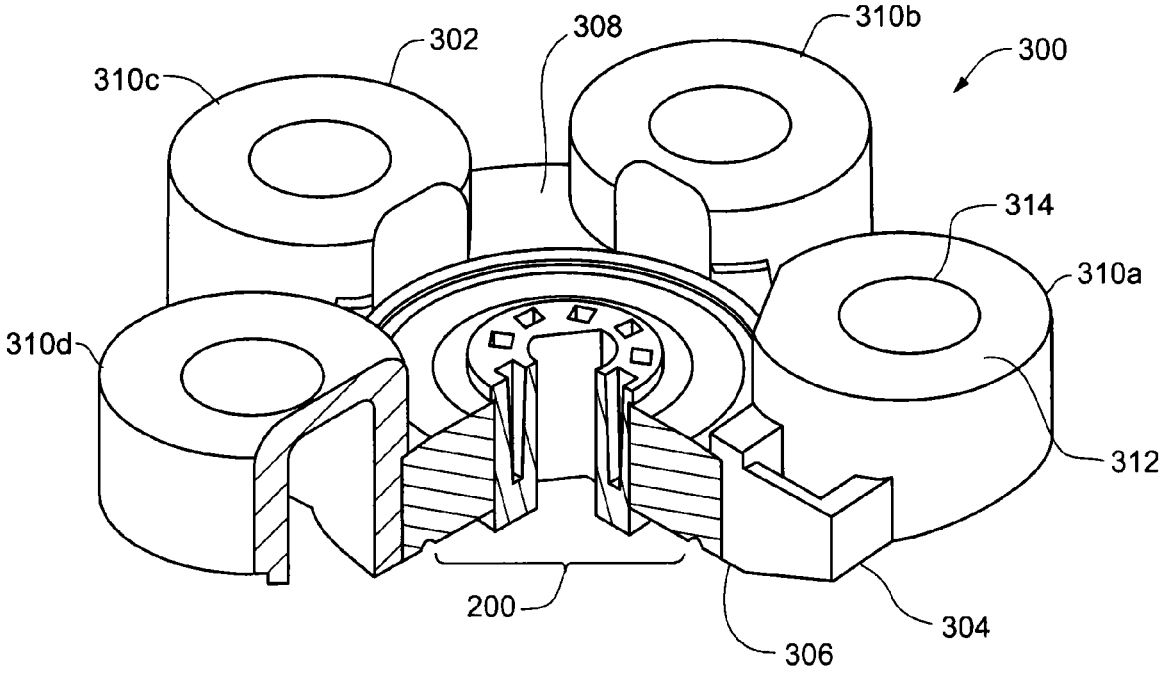
FIG. 16 is a top perspective sectional view of a wobble plate and bearing assembly according to an embodiment of the invention.

An outer race 127 of bearing 126 is then coupled directly to wobble plate 128 to form wobble plate/bearing assembly 300 depicted in FIG. 16. Specifically, wobble plate 128 comprises structure defining a central boss 130 for receiving cam/bearing assembly 200 therein. The connection between outer race 127 of bearing 126 and wobble plate 128 is such that cam/bearing assembly 200 is stopped from pulling out of wobble plate 128, and to prevent wobble plate 128 from rotating relative to outer race 127 of bearing 126. Wobble plate/bearing assembly 300 is described in more detail infra.

Wobble plate 128 comprises a plurality of piston sections 132 formed on a first face 131 of wobble plate 128 such that each piston section 132 extends from first face 131 of wobble plate 128. In one exemplary embodiment of the invention as depicted in FIG. 16, wobble plate 128 comprises five piston sections 132*a*-132*e*. However, one of ordinary skill in the art would recognize that fewer or more than five piston sections are contemplated.

A one-piece diaphragm 134 made from a resilient material, such as rubber, is secured by conventional fastening means (e.g. screws) to first face 131 of wobble plate 128. Diaphragm 134 can be relatively planar, or can comprise a plurality of piston structures 136 that fit over corresponding piston sections 132 of wobble plate 128. In one embodiment, piston structures 136 comprise convolutes.

Figure 9A:
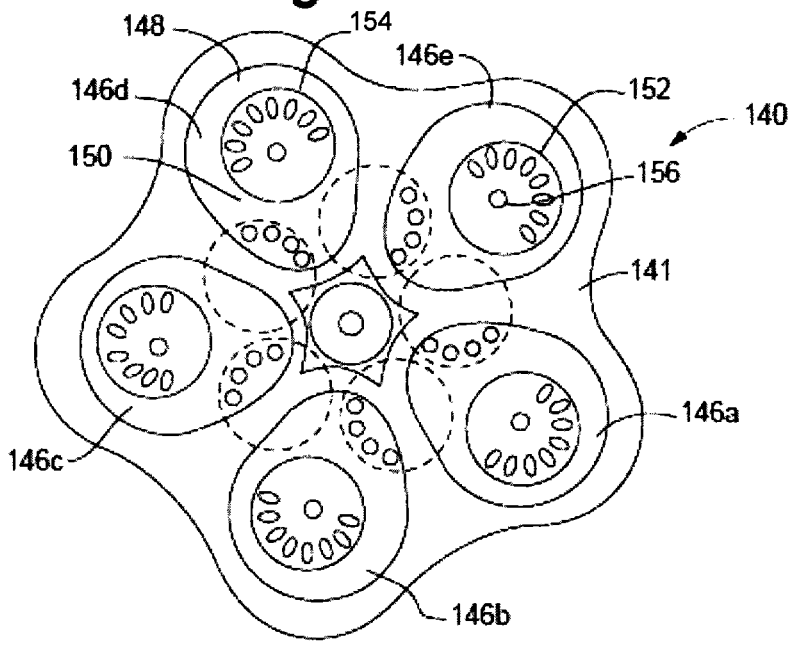
FIG. 9A is a top view of a first side of a valve housing according to embodiment of the invention.

A valve assembly 138 is sandwiched between front cover 102 and diaphragm 134. Valve assembly 138 generally comprises a valve housing 140, a plurality of inlet valves 142 secured to a first side 141 of valve housing 140, and a plurality of outlet valves 144 secured to a second, opposite side 143 of valve housing 140. Referring to FIG. 9A, first side 141 of valve housing 140 comprises a plurality of chambers 146, the number of chambers 146 corresponding to the number of piston sections 132 of wobble plate 128. In one exemplary embodiment of the invention as depicted in the figures, valve housing 140 comprises five chambers 146.

Each chamber 146 includes an upper section 148, and a lower section 150. Upper section 148 is preferably rounded, and lower section 150 is preferably tapered such that an outer periphery of each chamber 146 is teardrop- or egg-shaped. However, each chamber 146 can take any other shape desired, including, without limitation, round, rectangular, elongated, or irregular shapes.

Upper rounded section 148 comprises structure defining an inlet valve seat 152 for positioning an inlet valve 142 thereon. Inlet valve seat 152 includes a plurality of inlet apertures 154 extending therethrough creating fluid communication between the corresponding chamber 146 and inlet chamber 112 of front cover 102. Inlet apertures 154 can be any suitable shape, including, but not limited to, round, elongated, or oval-shaped. Upper rounded section 148 further comprises a valve mounting aperture 156 for receiving a central mounting section 158 or post of an inlet valve 142 for securing inlet valve 142 thereto.

Inlet valve 142 is preferably positioned within inlet valve seat 152 such that fluid is allowed to enter a corresponding chamber 146 from inlet chamber 112 through inlet apertures 154, but fluid cannot exit chamber 146 through inlet apertures 154. More specifically, a peripheral relief zone 160 or lip of inlet valve 142 covers inlet apertures 154 when inlet valve 142 is seated in valve seat 152 of each chamber 146. Inlet valve 142 is shiftable between an opened position such that peripheral relief zone 160 is significantly flexed or lifted out of the seat to allow fluid flow from inlet chamber 112 to a corresponding chamber 146 of valve housing 140 through inlet apertures 154, and a sealed position such that fluid flow is restricted or completely prevented through inlet apertures 154 such that there is no fluid communication between inlet chamber 112 and each chamber 146. The design of inlet valves 142 is described in further detail infra.

Second side 143 of valve housing 140 comprises a central output region 158 defined at a periphery by a recessed track 160 corresponding in shape to wall surround 118 of front cover 102 such that wall surround 118 fits in mating relationship with recessed track 160. In one embodiment of the invention, recessed track 160 comprises a pentagon-shaped track having five sides, corresponding to a pentagon-shaped wall surround 118 defining outlet chamber 114 of front cover 102. Central output region 158 is surrounded by external surfaces of upper portions 148 of chambers 146 in fluid communication with inlet chamber 112 of front cover 102.

Figure 9B:
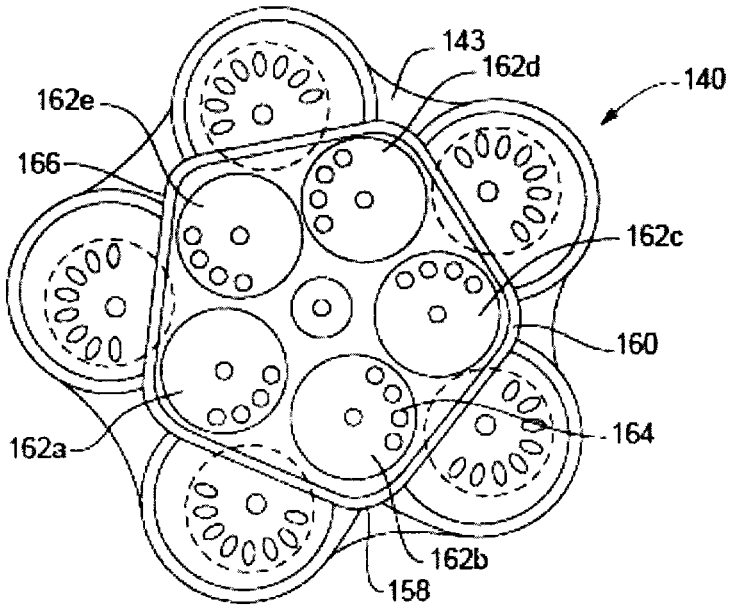
FIG. 9B is a top view of a second side of the valve housing of FIG. 9A.
Figure 10A:
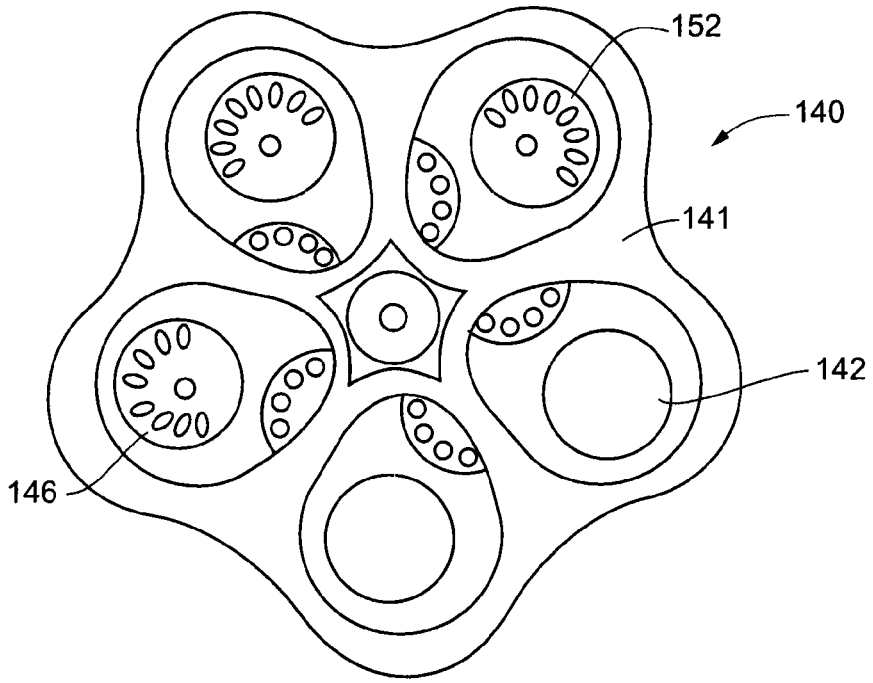
FIG. 10A is a top view of the first side of the valve housing of FIG. 9A with inlet valves mounted therein.
Figure 10B:
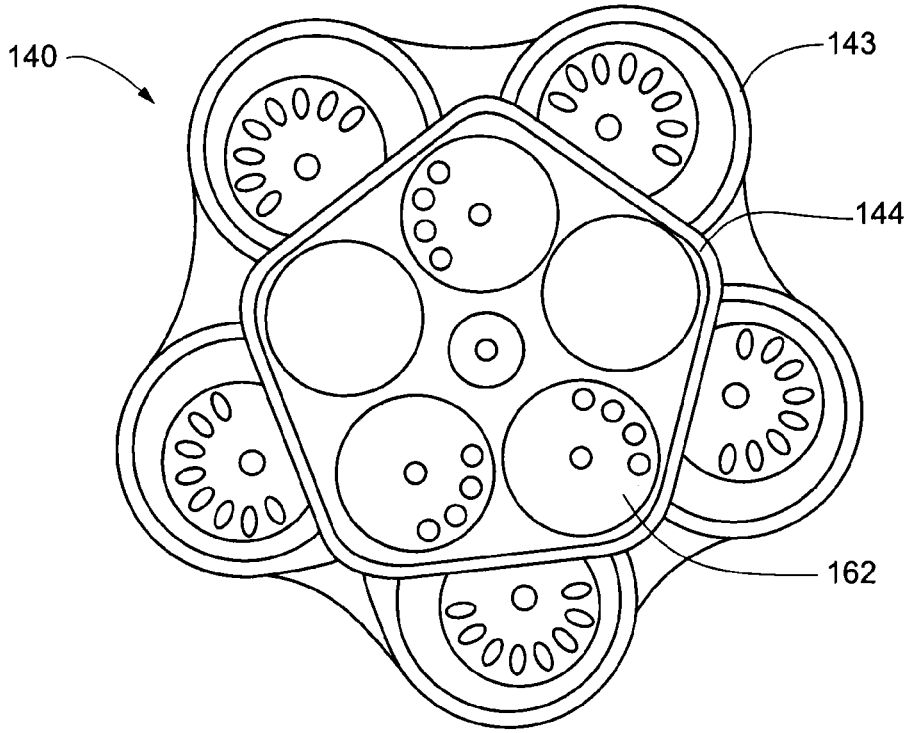
FIG. 10B is a top view of the second side of the valve housing of FIG. 9B with outlet valves mounted therein.
Figure 11:
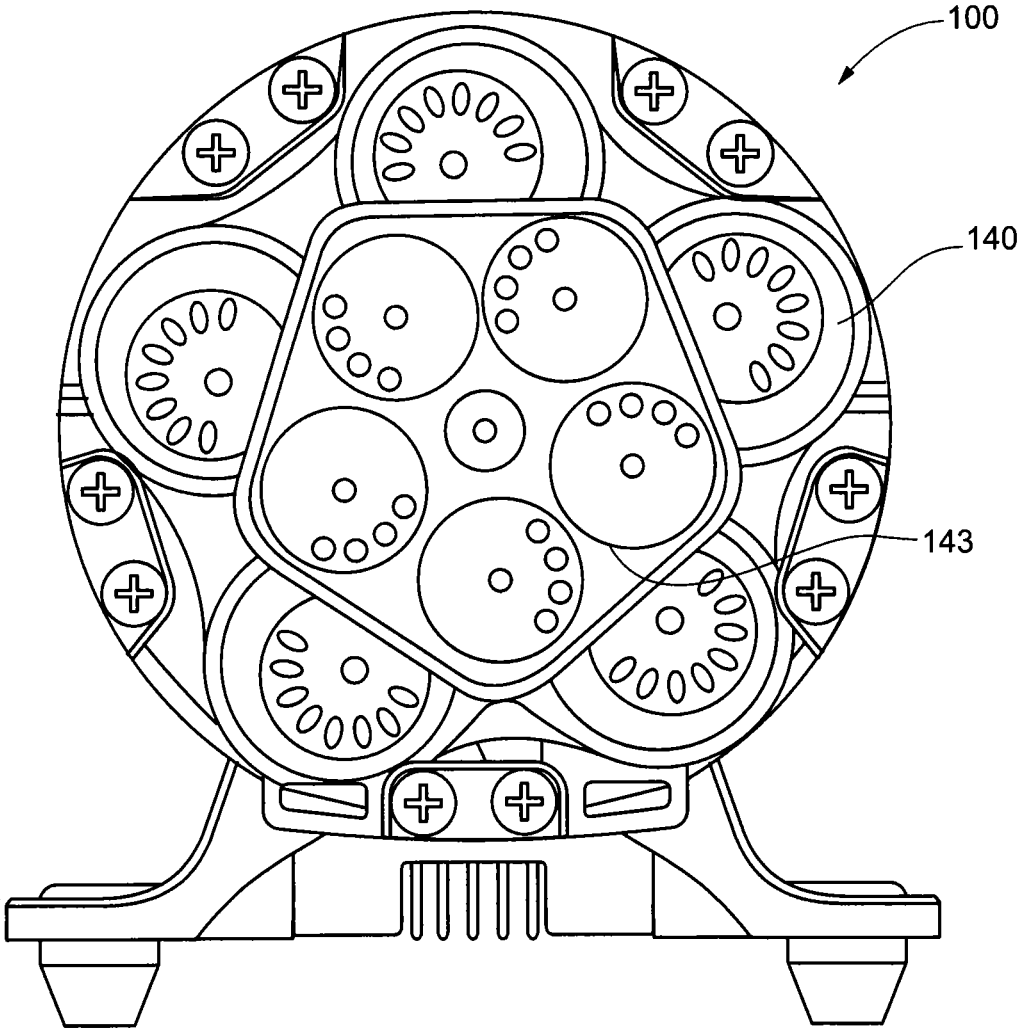
FIG. 11 is a cross-sectional plan view of the diaphragm pump of FIGS. 7A and 7B.

Within central output region 158, second side 143 of valve housing 140 comprises a plurality of outlet valve seats 162 for positioning an outlet valve 144 thereon. The number of outlet valve seats 162 corresponds with the number of chambers 146. In one exemplary embodiment shown in FIG. 9B, second side 143 of valve housing 140 comprises five outlet valve seats 162*a*-162*e*. Outlet valve seats 162 are offset from chambers 146 of first side 141 such that each outlet valve seat 162 extends between or straddles two chambers 146.

Outlet valve seat 162 includes a plurality of outlet apertures 164. Outlet apertures 164 can be any suitable shape, including, but not limited to, round, elongated, or oval-shaped. Each outlet aperture of a plurality of outlet apertures 164 extends through valve housing 140 such that each outlet aperture 164 is in selective fluid communication with a lower portion 150 of a single chamber 146.

Figure 24:
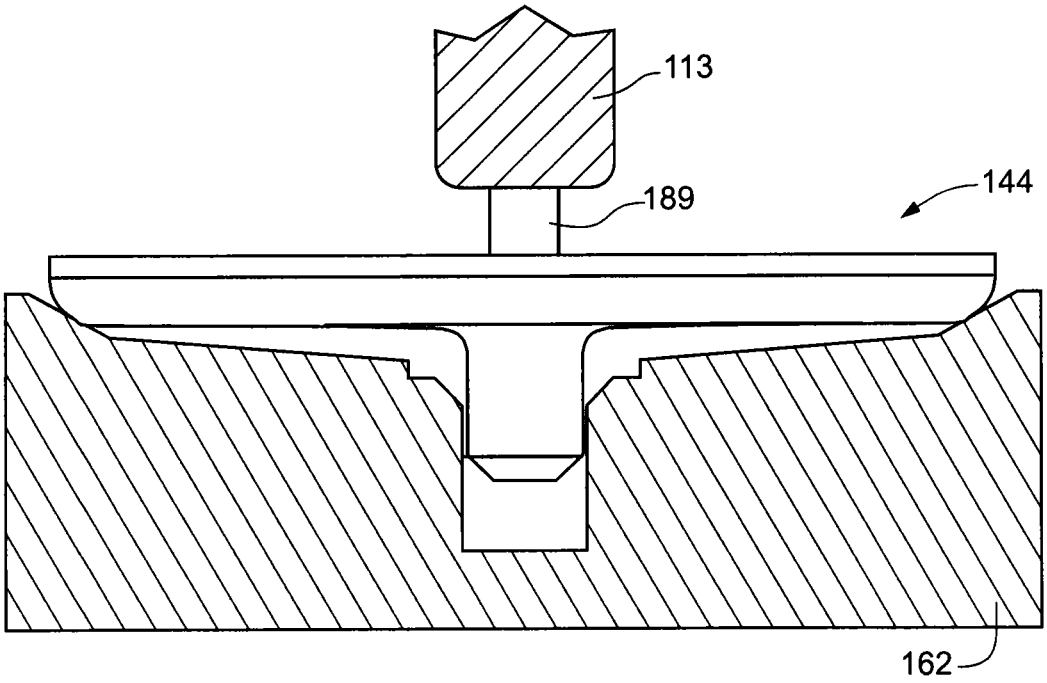
FIG. 24 is a cross-sectional view of the outlet valve of FIG. 5A.

Outlet valve seat 162 further comprises structure defining a valve recess 66 for receiving a central mounting section 168 or post of an outlet valve 144 for radially (or laterally) securing outlet valve 144 thereto. In one embodiment, valve recess 66 does not extend entirely through valve housing 140. Outlet valve 144 is additionally secured axially (or vertically) by abutment with post 113 extending from floor 116 of outlet chamber 114 of front cover 102, as depicted in FIG. 24.

Outlet valve 144 is preferably positioned within outlet valve seat 162 such that fluid is allowed to exit a corresponding chamber 146 through outlet apertures 164 to outlet chamber 114 of front cover 102, but fluid cannot enter the corresponding chamber 146 of valve housing 140 through outlet apertures 164. More specifically, a peripheral relief zone 170 or lip of outlet valve 144 covers only outlet apertures 164 of an outlet seat 162 in which it is mounted. Outlet valve 144 is shiftable between an opened position such that peripheral relief zone 170 is significantly flexed or lifted out of the seat to allow fluid flow from a corresponding chamber 146 of valve housing 140 through which outlet apertures 164 extend and outlet chamber 114 of front cover 102, and a sealed position such that fluid flow is restricted or completely prevented through outlet apertures 164 such that there is no fluid communication between the corresponding chamber 146 and the outlet chamber 114. The design of outlet valves 144 is described in further detail infra.

During pump operation, drive shaft 122 of motor assembly 106 rotates. Cam 124 acts as an eccentric, converting rotational movement of drive shaft 122 of motor assembly 106 to push-pull motion of a piston. More specifically, cam 124 creates an offset motion of wobble plate 128 such that a piston section 132 of wobble plate 128 forces a piston structure 136 of diaphragm 134 into and out of a chamber 146 of valve housing 140. Upper section 148 of each chamber 146 of valve housing 140 is sized to receive a corresponding piston section 132 of wobble plate 128 and piston structure 136 of diaphragm 134. The combination of piston sections 132 of wobble plate 128, diaphragm 134, and the fluid present in chamber 146 create a piston for reciprocating action within chamber 146, thereby forming a chamber/piston relationship.

Fluid is introduced into inlet chamber 112 of front cover 102 via inlet port 108. During an intake stroke, or retraction of a piston from chamber 146, a pressure in chamber 146 of valve housing 140 decreases such that inlet valve 142 opens and fluid is forced into chamber 146 from inlet chamber 112 of front cover 102 through inlet apertures 154. During a discharge stroke, or entry of the piston into chamber 146, the pressure in chamber 146 increases over a pressure in outlet chamber 114 to force outlet valve 144 open such that fluid is forced out of chamber 146 into outlet chamber 114 of front cover 102 via outlet apertures 164, and ultimately out of outlet chamber 114 via outlet port 110. Due to the offset camming action of the cam/bearing assembly 200 and wobble plate 128 relationship, wobble plate 128 is subject to nutating motion, causing reciprocating action of pistons of diaphragm sequentially into and out of chambers 146 of valve housing 140 to provide a pumping action.

As discussed in the Background section, a common failure for conventional diaphragm pumps is loosening of the cam in the bearing, and/or the bearing loosening in the wobble plate. This can significantly reduce the operation hours of a pump and/or the flow volume.

Figure 12:
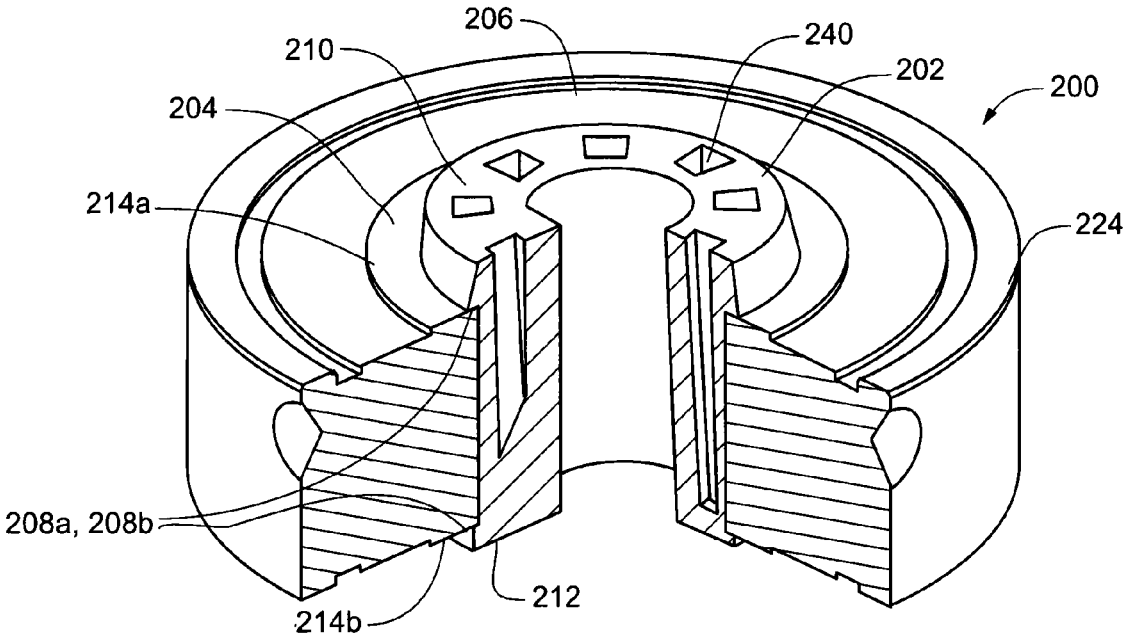
FIG. 12 is a top perspective sectional view of a cam and bearing assembly according to an embodiment of the invention.
Figure 13:
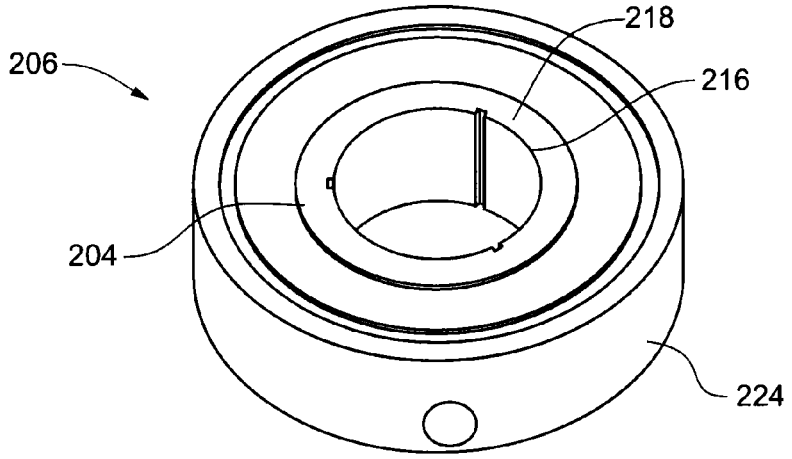
FIG. 13 is a top perspective view of a bearing according to an embodiment of the invention.

According to one embodiment of the invention, as depicted in FIG. 12, an improved cam/bearing assembly 200 comprises a plastic cam 202 formed directly into inner race 204 of bearing 206 by injection molding. Cam 202 comprises an annular retaining lip 208*a*, 208*b* on both a first face 210 and a second face 212. First retaining lip 208*a* of first face 210 abuts a first outer face 214*a* of inner race 204 of bearing 206, and second retaining lip 208*b* abuts a second outer face 214*b* of inner race 204 of bearing 206 to prevent cam 202 from pulling out of bearing 206. One or more notches 216 are machined into an edge of annular wall 218 of inner race 204 of bearing 206 so that the plastic material of cam 202 flows into notches 216 such that cam 202 is prevented from rotating relative to inner race 204 of bearing 206.

Figure 14A:
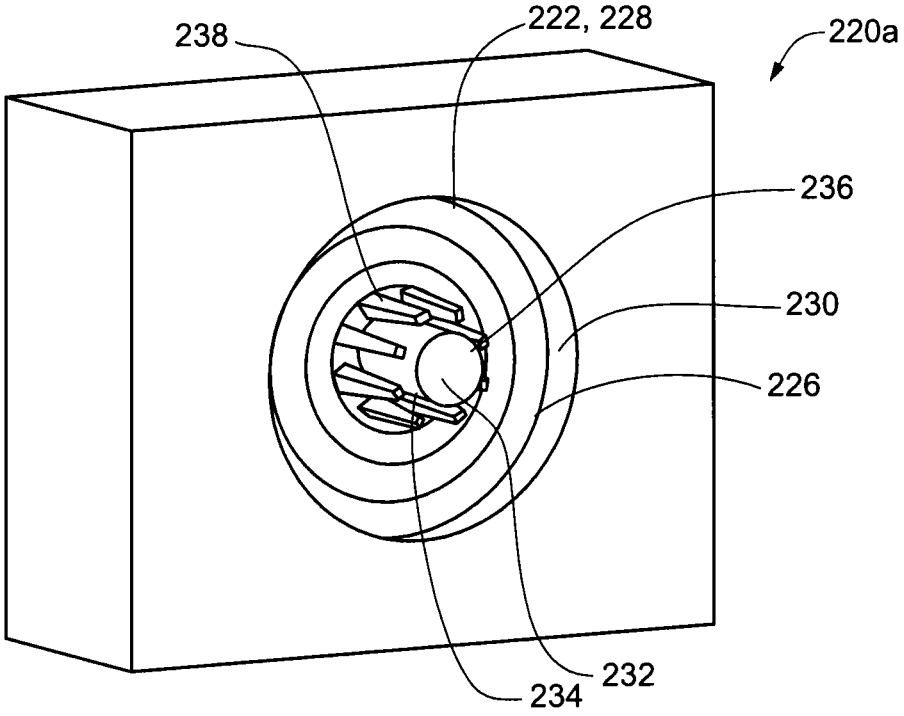
FIG. 14A is a first half of a cam mold according to an embodiment of the invention.
Figure 14B:
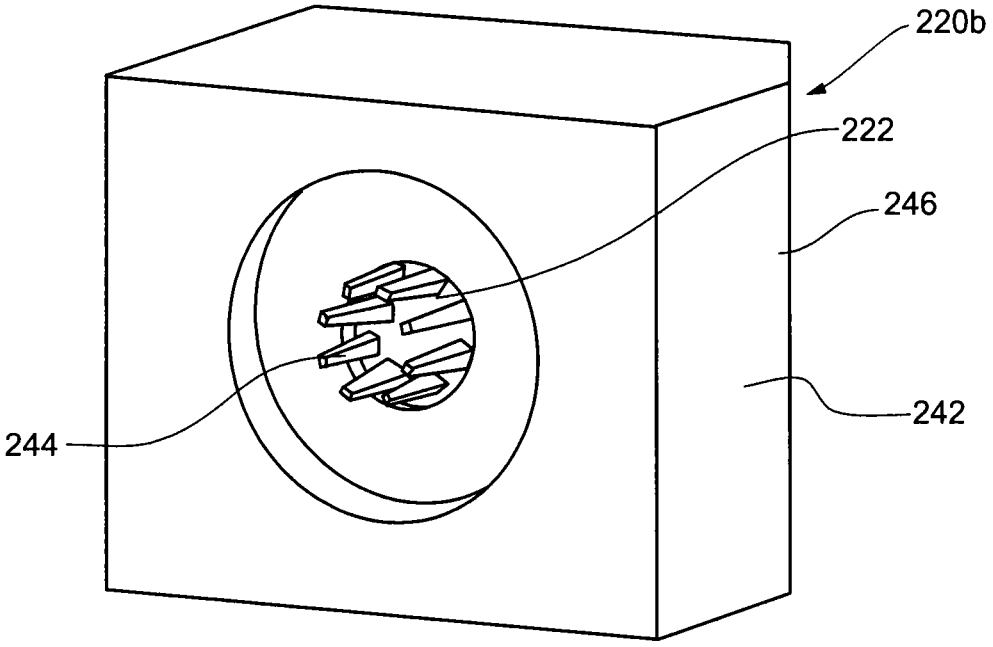
FIG. 14B is a second half of the cam mold of FIG. 14A.
Figure 15:
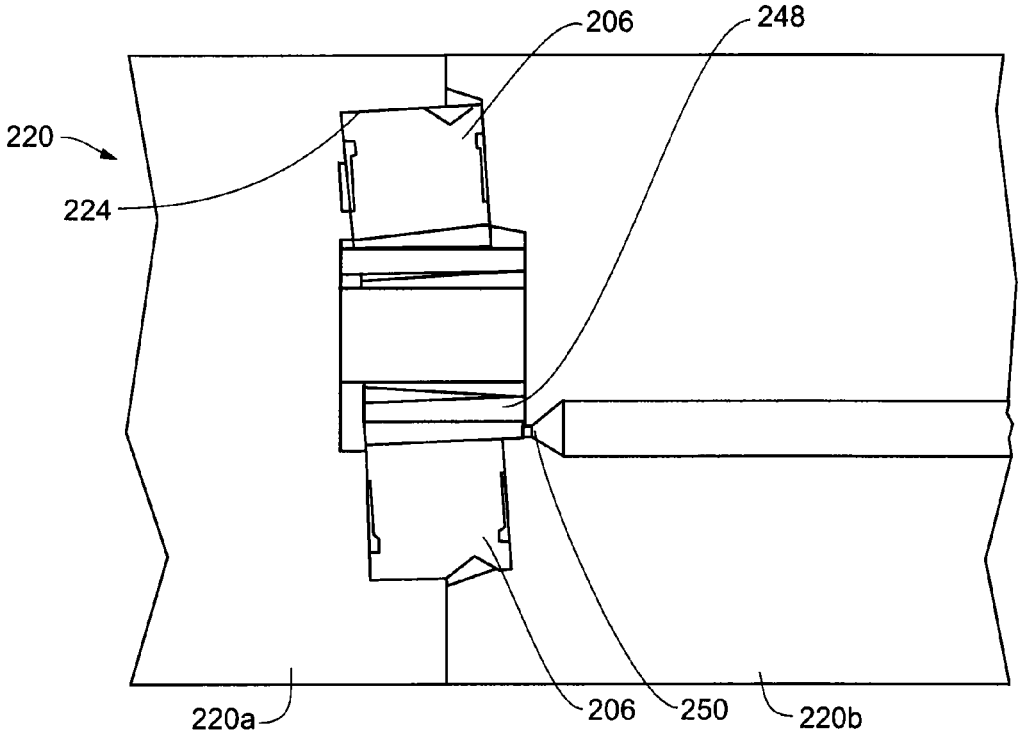
FIG. 15 is the first half and second half of the cam mold of FIGS. 14A and 14B sealed together.

To manufacture cam/bearing assembly 200, referring to FIG. 14A-15, a cam mold 220 having a first half 220*a* and a second half 220*b* is used. First half 220*a* of cam mold 220 includes a recessed portion 222 for positioning and retaining bearing 206 within. Outer race 224 of bearing 206 is used to center bearing 206 in first half 220*a* of mold 220. Optionally, magnets 226 can be placed within bottom wall 228 and/or annular side wall 230 of recessed portion to aid in retaining bearing 206 within first half 220*a* of mold 220. First half 220*a* further includes a center post for forming a central bore of cam 202. Center post 232 can include a rounded section 234 and a flat section 236 to form eccentric central bore of cam 202 for creating nutating action in wobble plate 302. A plurality of ribs 238 surrounds center post 232 for forming a plurality of apertures 240 in a first face 210 of cam 202.

Second half 220*b* of mold 220 includes a recessed portion 242 for accommodating bearing 206, and a center recessed section 244 for accommodating center post 232 of first half 220*a* of mold 220. Center recessed section 244 is of a sufficient depth such that an end of center post 232 abuts center recessed section 244 such that central bore of cam 202 is formed and extends through an entire depth of cam 202. Second half 220*b* also includes plurality of ribs 246 surrounding center recessed section 244 for forming a plurality of apertures in second face 212 of cam 202.

Once bearing 206 is positioned in first half 220*a* of mold 220, first and second halves 220*a*, 220*b* of mold 220 are sealed together as shown in FIG. 15. Mold halves 220*a*, 220*b* seal on inner race 204 of bearing 206. An interior space 248 is defined by inner race 204 of bearing 206 including notches 216 formed on annular wall 218 of inner race 204, center post 232, and ribs 238, 246 of both first and second half 220*b* of mold 220. Second half 220*b* of mold 220 includes a gate 250 for plastic injection. Molten plastic material is injected into interior space 248 of mold 220 to form cam 202. Upon cooling of the plastic material, mold 220 halves are unsealed, and cam/bearing assembly 200 is ejected from mold 220.

Figure 17:
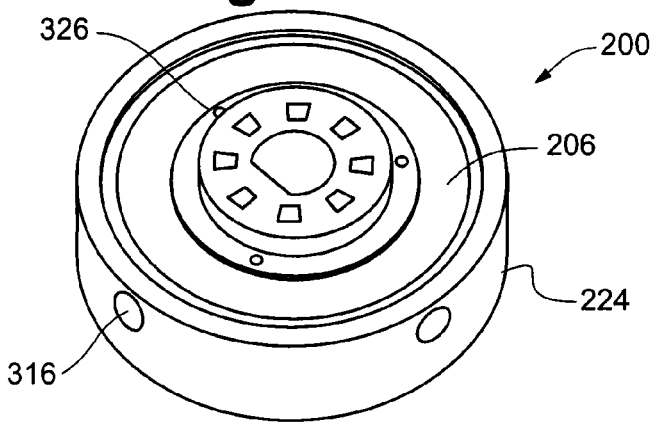
FIG. 17 is a top perspective view of the cam and bearing assembly of FIG. 12.

Referring to FIGS. 16 and 17, cam/bearing assembly 200 is used to further create wobble plate/bearing assembly 300. Wobble plate/bearing assembly 300 comprises cam/bearing assembly 200 described above, and a plastic wobble plate 302 formed around cam/bearing assembly 200 by injection molding. Wobble plate 302 includes an annular ring 304 having a central bore 314 for receiving and retaining cam/bearing assembly 200 therein, structure defining a plurality of apertures 308 extending through annular ring 304, and a plurality of piston sections 310 extending from annular ring 304. Each piston section 310 includes a ring section 312 and a central bore 314 for receiving and securing diaphragm 134 thereon. As discussed above, piston section 310*a* drives corresponding piston structure 136 of diaphragm 134 into and out of corresponding chamber 146 of valve housing 140 to form a piston/chamber relationship for reciprocating pumping action.

An outer race 224 of bearing 206 of cam/bearing assembly 200 is machined with one or more dimples 316 such that plastic material forming wobble plate 302 flows into dimples 316 to prevent cam/bearing assembly 200 from pulling out of wobble plate 302, and to prevent wobble plate 302 from rotating relative to outer race 224 of bearing 206.

Figure 18A:
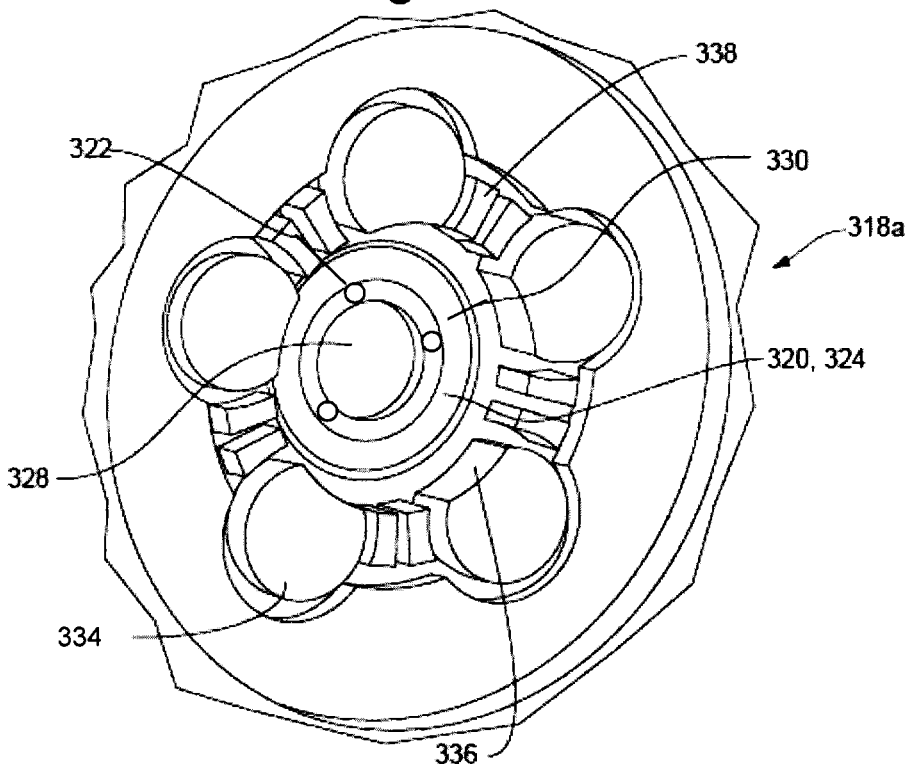
FIG. 18A is a front view of a first half of a wobble plate mold according to an embodiment of the invention.
Figure 18B:
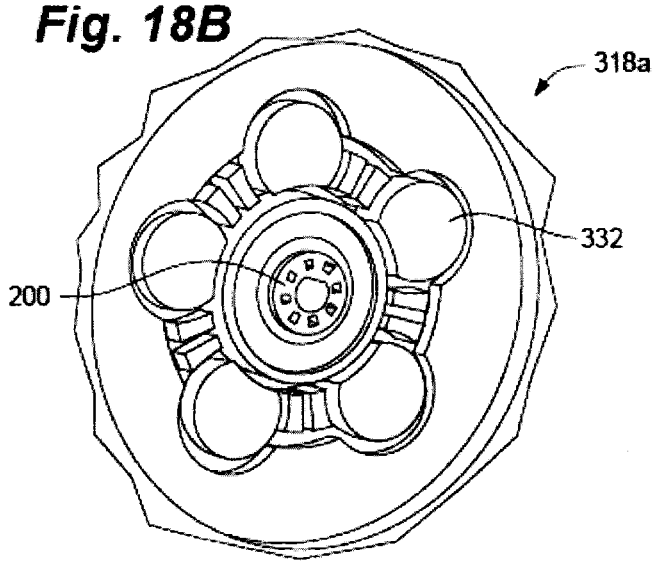
FIG. 18B is a front view of the first half of the wobble plate mold of FIG. 18A with a cam and bearing assembly secured therein.
Figure 19:
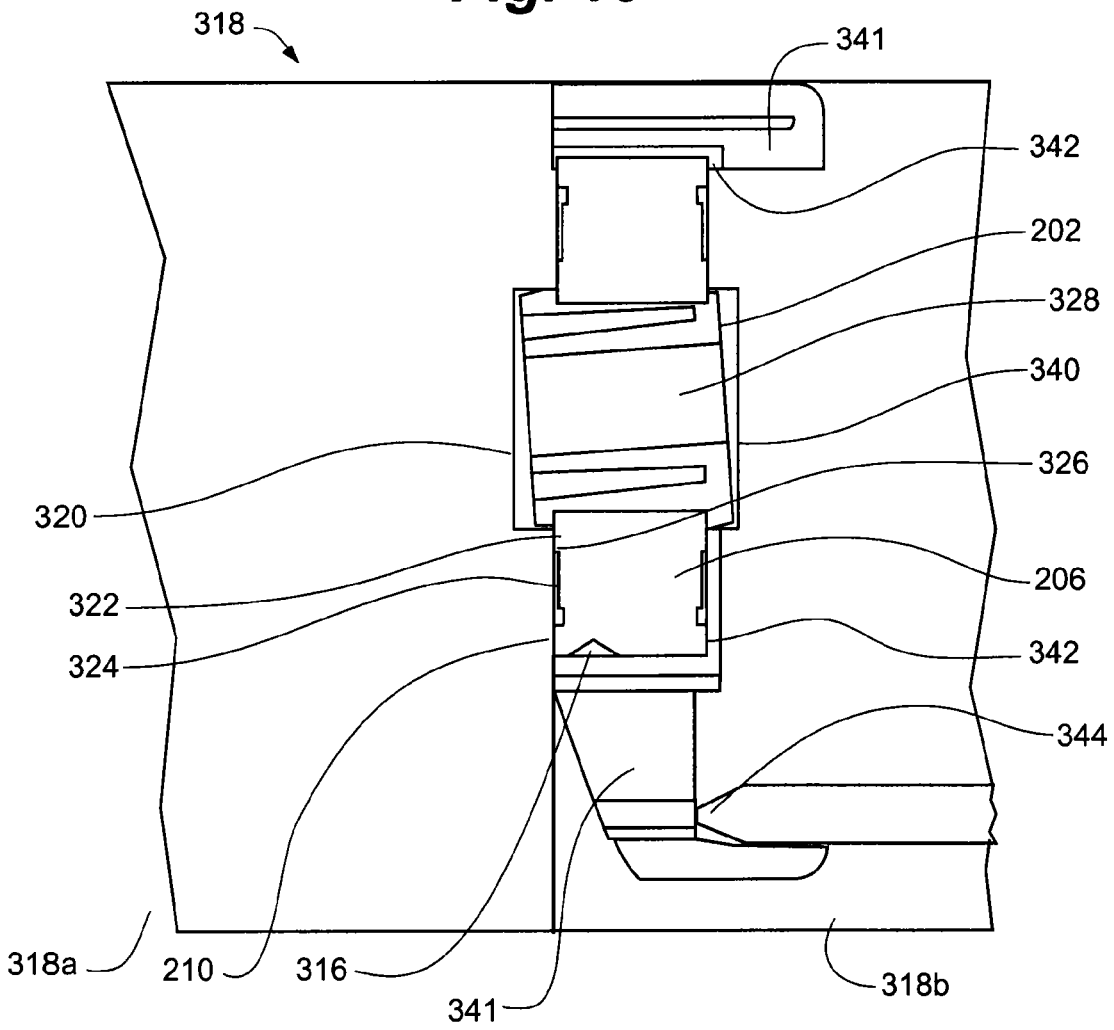
FIG. 19 is the first half and second half of the wobble plate mold of FIGS. 18A and 18B sealed together.
Figure 20A:
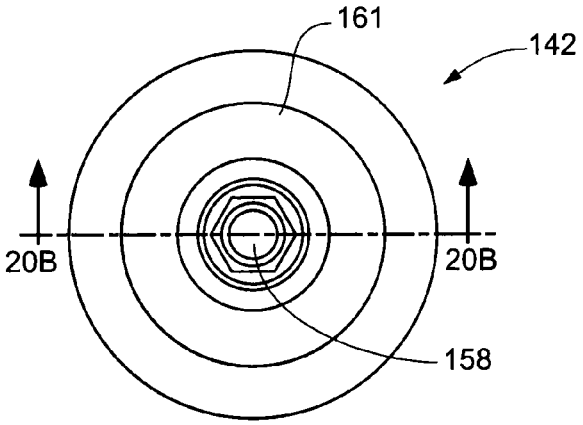
FIG. 20*a* is a top view of an inlet valve according to an embodiment of the invention.
Figure 20B:
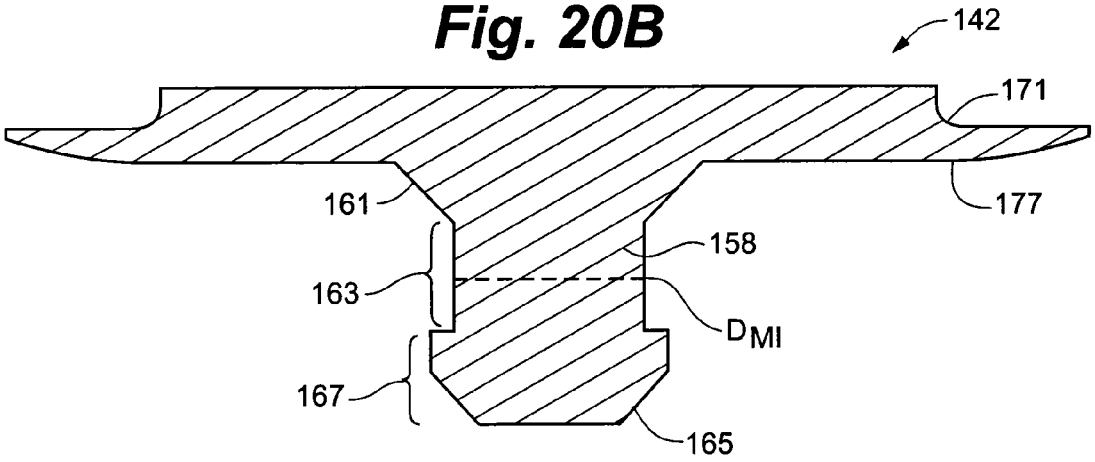
FIG. 20*b* is a cross-sectional view of the inlet valve of FIG. 20*a* at 20*a*-20*a*.

To manufacture wobble plate/bearing assembly 300, and referring to FIGS. 18A-19, a wobble plate mold 318 having a first half 318*a* and a second half 318*b* is used. First half 318*a* of wobble plate mold 318 includes a recessed portion 320 for positioning and retaining cam/bearing assembly 200 within. Pegs 322 formed on a bottom face 324 of recessed portion 320 correspond with sockets 326 machined on a face of inner race 204 of bearing 206 to form a mating relationship to aid in positioning cam/bearing assembly 200 in center of wobble plate 302. Recessed portion 320 surrounds and defines a center cavity 328 for isolating cam 202 so that cam 202 does not interfere with the tooling of mold 318. Optionally, magnets or a magnetic strip 330 can be placed within a portion of bottom wall and/or annular side wall of recessed portion 320 to aid in retaining bearing 206 within first half 318*a* of mold 318.

First half 318*a* further includes a plurality of posts 332 for forming central bore 314 of each piston section 310 of wobble plate 302. In one embodiment as shown, each post 332 can include a rounded section 334 and a concave section 336, or any of a variety of shapes to form the desired piston section. One or more ribs 338 are positioned between each piston section 310 for forming a plurality of apertures 308 in ring section 312 of wobble plate 302.

Second half 318*b* of mold 318 includes a recessed portion 340 for accommodating bearing 206, and a center cavity 328 for isolating cam 202 as described above.

Once bearing 206 is positioned in first half 318*a* of mold 318, first and second halves 318*a*, 318*b* of mold 318 are sealed together as shown in FIG. 19. Mold halves seal on outer race 224 of bearing 206. An interior space 341 is defined by outer race 224 of bearing 206 including dimples formed on outer race 224, posts, and ribs of first half 318*a* of mold 318. A depth of recessed portion for bearing 206 is slightly shallower than a depth of interior space such that an inner wall of ring section of wobble plate 302 creates a slight overlap or lip 342 abutting an outer most edge of each face of outer race 224 of bearing 206 to further secure wobble plate 302 to cam/bearing assembly 200.

Second half 318*b* of mold 318 includes a gate 344 for plastic injection for each piston section of wobble plate 302. Molten plastic material is injected into the interior space 341 of mold 318 to form wobble plate 302. Upon cooling of the plastic material, mold halves 318*a*, 318*b* are unsealed, and wobble/plate bearing assembly 300 is ejected from mold 318.

As discussed in the Background Section, prior art inlet and outlet valves, as depicted in FIGS. 3A-6B, have limited effective sealing area when placed in the valve seat of the valve housing 140.

Referring to FIGS. 20A-21B, an improved inlet valve 142 is depicted. Inlet valve 142 comprises a one-piece construction molded from a suitable material, such as rubber. Inlet valve 142 includes a central mounting section 158, such as a post, and a resilient, seal-forming section 159 surrounding post 158 at a first end of post 158. Post 158 further includes a longitudinal middle section 163 having a constant diameter $D_{mi}$, and a second, opposing end 165 of the post 158 receivable within a bore of a chamber 146 of valve housing 140. Second opposing end 165 of the post 158 includes a tapered section 167 having a first diameter greater than a constant diameter of middle section, and tapering to a diameter equal to or less than the constant diameter of the middle section. The first diameter thereby creates a shoulder surrounding an end of middle section, for abutment against an opposite side of the valve housing 140 when the post 158 is passed through the bore. This ensures that inlet valve 142 remains in position in valve housing 140 during operation.

Figure 21A:
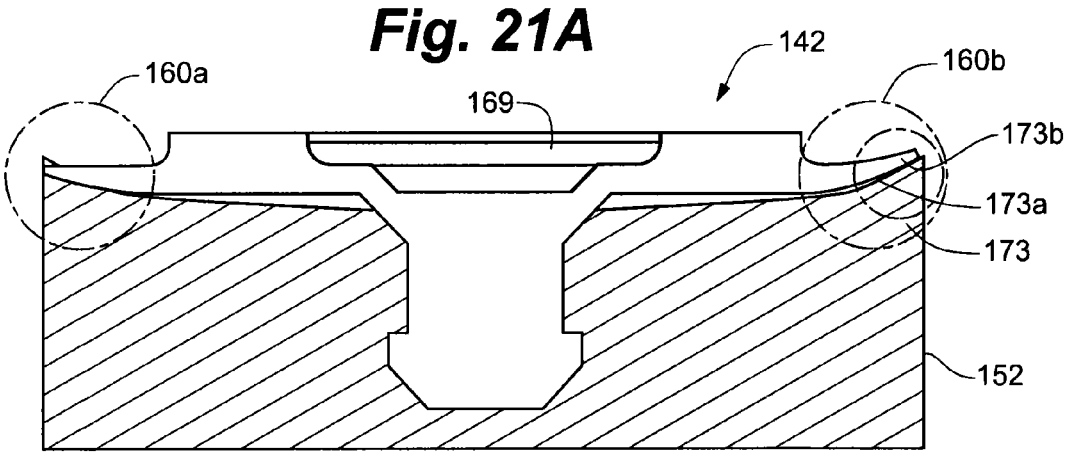
FIG. 21*a* is a cross-sectional view of the inlet valve of FIG. 20*b* in a valve seat.
Figure 21B:
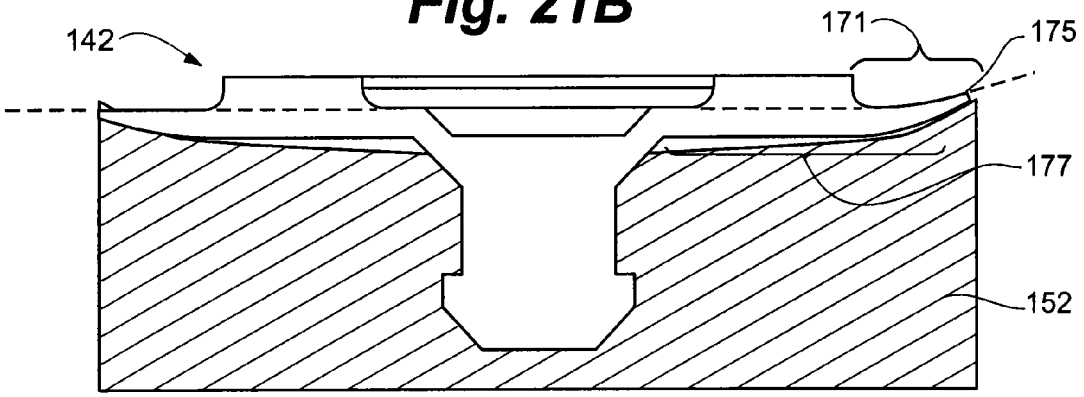
FIG. 21*b* is a cross-sectional view of the inlet valve of FIG. 20*b* in a valve seat depicting a mold parting line.

Referring to FIGS. 21A and 21B, inlet valve 142 is depicted being mounted in a valve seat 152 of a chamber 146 of the valve housing 140. Resilient portion 159 includes a center section 169 and a peripheral relief zone 160 or lip. A first edge 160*a* of the peripheral relief zone 160 is shown in the relaxed position, i.e. how the valve naturally lies prior to being assembled within the valve seat, while a second edge 160*b* is shown in the slightly flexed or sealed position, i.e. when the piston of the diaphragm is moving into the chamber 146 in which inlet valve 142 is mounted such that fluid flow is restricted or completely prevented. Inlet valve 142 is in an opened position when peripheral relief zone 160 is significantly flexed such that it is lifted out of valve seat 152 to allow fluid flow from inlet chamber 112 to chamber 146.

Removal of material forming the "stepped" portion in the prior art valve results in a diminishing cross section from central section 169 to peripheral relief zone 160 such that peripheral relief zone 160 includes a rounded or sloped portion 171 on a first side of resilient portion 159, and having a mathematical or cross-sectional profile comprising a continuous function, and a second rounded or sloped sealing or seating portion 177 on a second side of resilient portion 159, second seating portion 177 also having a mathematical or cross-sectional profile comprising a continuous function. This rounded or sloped edge surface design slightly flexes to form a band of sealing area, as opposed to a line, thereby creating larger effective sealing area 173 than the prior art inlet valve, reducing sealing inconsistencies. This effective sealing area 173 is bounded by a first circumference 173*a*, i.e. a circumference at an innermost radial location where peripheral relief zone 160 makes contact with the valve seat, and a second circumference 173*b*, i.e. a circumference at an outermost radial location of peripheral relief zone 160 where the valve makes contact with the valve seat. The circumferential band or ring extending between first and second circumferences 173*a*, 173*b* is effective sealing area 173.

Furthermore, referring to FIG. 21B, the rounded edge design moves the mold parting line 175 of the mold in manufacturing to a non-critical area of the valve that has no effect on sealing performance, thereby reducing or eliminating further sources of sealing inconsistencies.

Figure 22A:
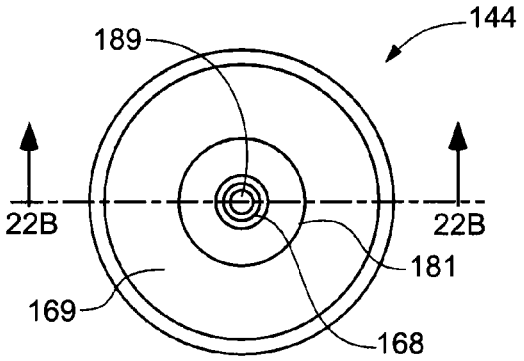
FIG. 22*a* is a top view of an outlet valve according to an embodiment of the invention.
Figure 22B:
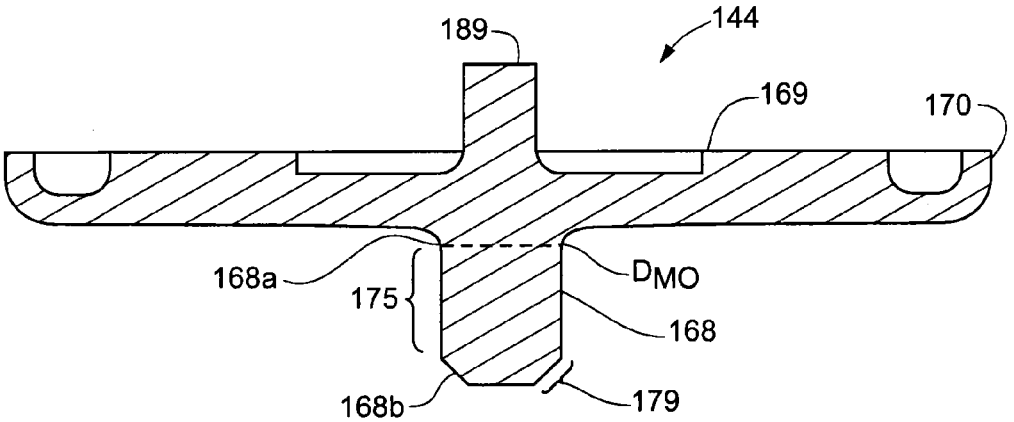
FIG. 22*b* is a cross-sectional view of the outlet valve of FIG. 22*a* at 22*a*-22*a*.

Referring to FIGS. 22A-22B, an improved outlet valve 144 is depicted. Outlet valve 144 comprises a one-piece construction molded from a suitable material, such as rubber. Outlet valve 144 includes a central mounting section 168, such as a post, a resilient, seal-forming section 169 surrounding post 168 at a first end 168*a* of post 168, and a second post 189. Post 168 further includes a longitudinal middle section 175 having a constant diameter $D_{mo}$, and a second, opposing end 168*b* of post 168 receivable within a recess 166 formed in an exterior of valve housing 140. Middle section 175 of post 168 radially (or laterally) secures outlet valve 144 within recess 166, and post 113 extending from floor 116 of outlet chamber 114 of top cover 102 abuts or presses against second post 189 of outlet valve 144 to additionally axially (or vertically) secure outlet valve 144 to ensure that outlet valve 144 remains in position in the valve seat 162 during operation of the pump.

Optionally, second opposing end 168*b* of post 168 includes a tapered section 179 having a first diameter equal to the constant diameter of middle section 175, and tapering to a diameter less than the constant diameter of middle section 175.

Figure 23A:
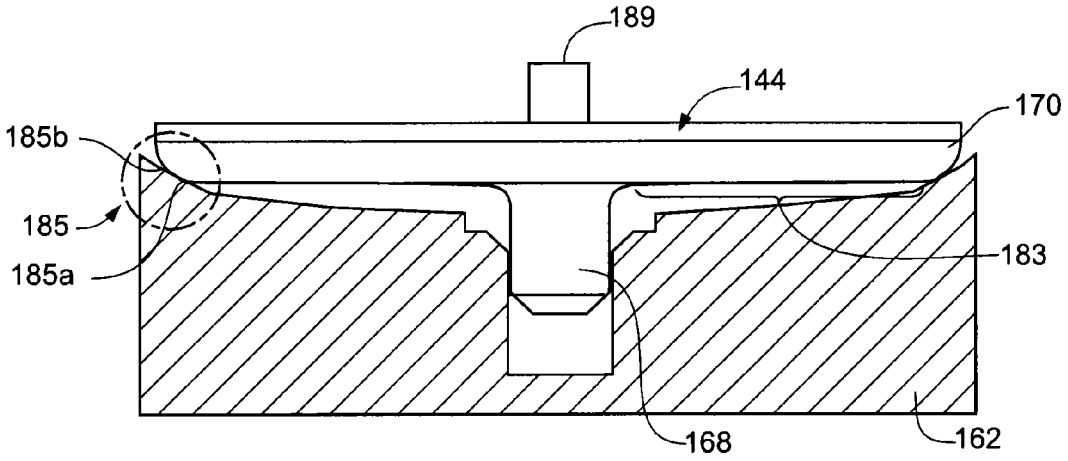
FIG. 23*a* is a cross-sectional view of the inlet valve of FIG. 22*b* in a valve seat.
Figure 23B:
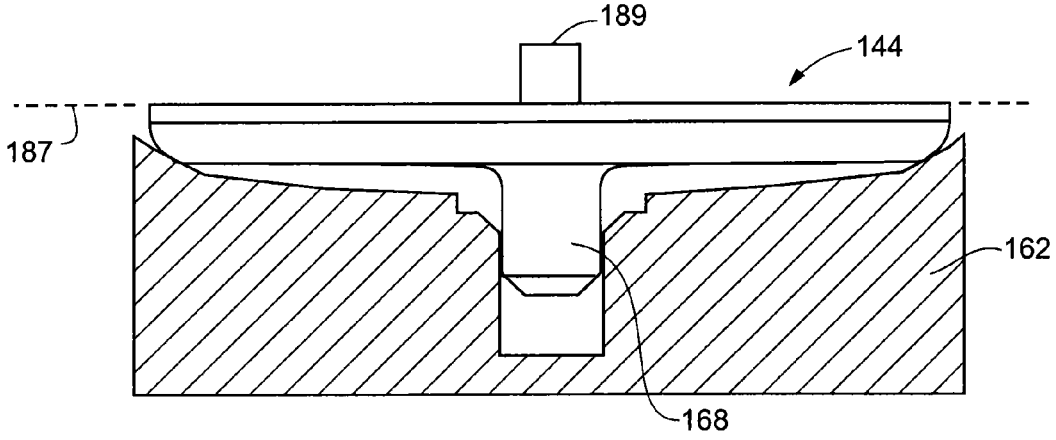
FIG. 23*b* is a cross-sectional view of the inlet valve of FIG. 22*b* in a valve seat depicting a mold parting line.

Referring to FIGS. 23A, 23B, and 24, outlet valve 144 is depicted being mounted in a valve seat 162 on an exterior of a chamber 146 of the valve housing 140. Resilient portion 169 includes a center section 181 and a peripheral relief zone 170 or lip. Lip 170 is shown in the slightly flexed or sealed position, i.e. when the piston of the diaphragm is moving out of the chamber 146 on which the outlet valve 144 is mounted such that fluid flow is restricted or completely prevented. Outlet valve 144 is in an opened position when peripheral relief zone 170 is significantly flexed such that it is lifted out of valve seat 162 to allow fluid flow from chamber 146 to outlet chamber 114. Removal of an annular section of material forming the "stepped" portion in the prior art valve results in a thinner cross section of material near peripheral relief zone 170, and includes a rounded edge or sloped seating portion 183 on an interior surface of resilient portion 169, and having a mathematical or cross-sectional profile comprising a continuous function. This rounded or sloped edge surface design flexes to form a band of sealing area, as opposed to a line, thereby creating larger effective sealing area 185 than the prior art outlet valve, reducing sealing inconsistencies. This effective sealing area 185 is bounded by a first circumference 185*a*, i.e. a circumference at an innermost radial location where peripheral relief zone 170 makes contact with the valve seat, and a second circumference 185*b*, i.e. a circumference at an outermost radial location of peripheral relief zone 170 where the valve makes contact with the valve seat. The circumferential band or ring extending between first and second circumferences 185*a*, 185*b* is effective sealing area 185.

Furthermore, referring to FIG. 23B, the rounded edge design moves the mold parting line 187 of the mold in manufacturing to a non-critical area of the valve that has no effect on sealing performance, thereby reducing or eliminating further sources of sealing inconsistencies.

The combination of improved inlet and outlet valve designs improves the function and efficiency of the pump because of larger effective sealing areas, and reduced sealing inconsistencies.

An improved diaphragm pump according to embodiments of the invention generally includes the cam and bearing assembly and the wobble plate and bearing assembly that can withstand the loads placed thereon, thereby eliminating or reducing the dislocation of either the cam from the bearing, or the wobble plate from the bearing. This acts to increase the pump operating time and reliability from the prior art pumps up to ten times or more. In addition to or alternatively to, the improved design of both the inlet and outlet check valves of the valve housing creates better sealing consistency by increasing the effective sealing area with the valve seat. This also increases the efficiency of the pump because it eliminates or reduces the occurrence of leaks and/or backflow, while maintaining high flow efficiency through the pump.

The foregoing descriptions present numerous specific details that provide a thorough understanding of various embodiments of the invention. It will be apparent to one skilled in the art that various embodiments, having been disclosed herein, may be practiced without some or all of these specific details. In other instances, components as are known to those of ordinary skill in the art have not been described in detail herein in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments may be constructed that nevertheless employ the principles and spirit of the present invention. Accordingly, this application is intended to cover any adaptations or variations of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A diaphragm pump including a wobble plate assembly and a motor having a rotating drive shaft, the wobble plate assembly comprising:

a bearing including an inner race and an outer race, the outer race presenting a cylindrical outer surface with a plurality of separate dimples defined therein, each dimple comprising an indentation in the cylindrical outer surface, the dimples spaced apart around a circumference of the outer surface, the dimples disposed between opposing axial edges of the cylindrical outer surface, and the dimples axially spaced apart from each of the opposing axial edges of the cylindrical outer surface; and a wobble plate coupled to the drive shaft via the bearing, the wobble plate having an inner annular wall, wherein the wobble plate is secured to the outer race of the bearing by injection molding such that a portion of the inner annular wall extends into each of the plurality of dimples, abutting an entire outer-facing surface presented within the dimple, wherein the wobble plate is fixed in both lateral and rotational movement with respect to the outer race.

2. The pump of claim 1, wherein the pump further comprises a cam coupling the bearing to the drive shaft, wherein the inner race of the bearing defines at least one notch, wherein the cam comprises a plastic cam member secured within an inner race of the bearing by injection molding, such that a portion of the cam member extends into the at least one notch, wherein the cam member is fixed relative to the inner race of the bearing, and wherein the cam member is coupled to the drive shall such that it is fixed relative to the drive shaft.

3. The pump of claim 1, the diaphragm pump further comprising a valve assembly, the valve assembly including:

a valve plate presenting a first surface and a second surface, the first surface including structure defining a plurality of inlet valve seats, the second surface including structure defining a plurality of outlet valve seats, each inlet and outlet valve seat presenting a seating surface arranged around structure defining an opening;

a plurality of outlet valves, each outlet valve having a post and a seal forming section extending radially from and surrounding the post; and a plurality of inlet valves, each inlet valve having a post and a seal forming section extending radially from and surrounding the post, wherein each of the outlet and inlet valves has a cross-sectional profile including a sloped seating portion at a peripheral edge of the seal forming section, wherein the sloped seating portion is selectively engagable with the seating surface of a corresponding valve seat to form an effective sealing area such that fluid is prevented from flowing through the opening of the corresponding valve seat.

4. The pump of claim 3, wherein the effective sealing area is defined as an area between a first circumference at a first location on the peripheral edge and a second circumference spaced inwardly from the first location such that the first circumference is greater than the second circumference, forming a band, a first thickness dimension of the valve at the first circumference being less than a second thickness dimension of the valve at the second circumference.

5. The pump of claim 3, wherein the opening of each valve seat comprises structure defining a plurality of apertures.

6. The pump of claim 3, wherein the first surface of the valve plate comprises structure defining a plurality of chambers, wherein an inlet valve seat is positioned within each chamber.

7. The pump of claim 3, wherein the pump further comprises a front cover having an inlet chamber and an outlet chamber, wherein the opening of each of the inlet valve seats is in fluid communication with the inlet chamber of the front cover, and the opening of each of the outlet valve seats is in fluid communication with the outlet chamber of the front cover.

8. The pump of claim 7, wherein each of the outlet valves is selectively shiftable between an open position in which the sloped seating portion of the outlet valve is not engaged with the seating portion of the outlet valve seat such that fluid can flow through the opening into the outlet chamber of the front cover, and a sealed position in which the sloped seating portion is engaged with the seating portion to restrict fluid flow through the opening.

9. The pump of claim 7, wherein each of the inlet valves is selectively shiftable between an open position in which the sloped seating portion of the inlet valve is not engaged with the seating portion of the inlet valve seat such that fluid can flow through the opening from the inlet chamber of the front cover, and a sealed position in which the sloped seating portion is engaged with the seating portion to restrict fluid flow through the opening.

10. A wobble plate and bearing assembly, the wobble plate and bearing assembly comprising:

a bearing presenting an outer race and an inner race, the outer race presenting a cylindrical outer surface with a plurality of separate dimples defined therein, each dimple comprising an indentation in the cylindrical outer surface, the dimples spaced apart around a circumference of the outer surface, the dimples disposed between opposing axial edges of the cylindrical outer surface, and the dimples axially spaced apart from each of the opposing axial edges of the cylindrical outer surface; and a plastic wobble plate presenting a center ring for receiving a bearing within;

wherein the wobble plate secured to the outer race of the bearing by injection molding such that a portion of the center ring extends into each of the plurality of dimples, abutting an entire outer-facing surface presented within the dimple, so that the wobble plate is fixed in axial and rotational movement with respect to the outer race.

11. The wobble plate and bearing assembly of claim 10, wherein a face of the inner race of the bearing comprises structure defining sockets for positioning and releasably securing the bearing within a wobble plate mold for injection molding of the wobble plate.

12. The wobble plate and bearing assembly of claim 10, wherein at least one of a first edge and a second edge of an inner annular wall of the center ring wobble plate includes a retaining lip, and wherein the retaining lip abuts a corresponding outer face of the outer race of the bearing such that is wobble plate is laterally axially fixed with respect to the outer race of the bearing.

13. The wobble plate and bearing assembly of claim 10, wherein a cam comprising an injected molded plastic is secured within the inner race of the bearing, such that the cam is fixed in both lateral axial and rotational movement relative to the inner race of the bearing.

14. The wobble plate and bearing assembly of claim 13, wherein an annular wall of the inner race of the bearing includes structure defining one or more notches, wherein the notches and an outer annular wall of the cam are engaged such that the cam is prevented from rotating with respect to the inner race of the bearing.

15. The wobble plate and bearing assembly of claim 13, wherein at least one of an outer first face and an outer second face of the cam include an annular retaining lip, the annular retaining lip abutting a corresponding outer face of the inner race of the bearing, wherein the retaining lip prevents the cam from lateral axial movement with respect to the inner race of the bearing.

16. A diaphragm pump, the diaphragm pump comprising:

a housing comprising a front cover and a back cover, wherein the front cover includes an inlet port, an inlet chamber in fluid communication with the inlet port, an outlet port, and an outlet chamber in fluid communication with the outlet port;

a motor assembly comprising a motor and a rotatable drive shaft, wherein the rotatable drive shaft extends through structure defining an opening in the back cover;

a cam and bearing assembly coupled to the drive shaft, the cam and bearing assembly comprising a cam and a bearing, the bearing having an inner race and an outer race, the outer race presenting a cylindrical outer surface and defining a plurality of dimples, each dimple comprising an indentation in the cylindrical outer surface, the dimples spaced apart around a circumference of the outer surface and between opposing axial edges of the outer surface, and the dimples axially spaced apart from each of the opposing axial edges of the cylindrical outer surface, the cam comprising an injected molded plastic cam secured within the inner race of the bearing, such that the cam is fixed relative to the inner race of the bearing, and wherein the cam is coupled to the drive shaft such that it is fixed relative to the drive shaft;

a wobble plate secured to and fixed relative to an outer race of the bearing, the wobble plate including a plurality of piston structures and having an inner annular wall, the wobble plate injection molded to the bearing such that a portion of the inner annular wall extends into each one of the dimples, abutting an entire outer-facing surface presented within the dimple, so as to inhibit rotation of the wobble plate relative to the outer race of the bearing;

a diaphragm operably coupled to a face of the wobble plate, wherein the diaphragm and the plurality of piston structures form a plurality of pistons; and a valve assembly comprising a plurality of chambers and a plurality of check valves, wherein each chamber is in selective fluid communication with each of the inlet chamber and the outlet chamber, wherein the cam and bearing assembly are adapted to convert a rotating motion of the drive shaft to a nutating motion of the wobble plate, such that each piston engages a chamber of the valve assembly in sequential order, thereby forcing fluid into the chamber from the inlet chamber and out of the chamber in a reciprocating motion.

17. The pump of claim 16, wherein an annular wall of the inner race of the bearing includes structure defining one or more notches, wherein the notches and an outer annular wall of the cam are engaged such that the cam is prevented from rotating with respect to the inner race of the bearing.

18. The pump of claim 16, wherein a face of the inner race of the bearing comprises structure defining sockets for positioning and releasably securing the cam and bearing assembly within a wobble plate mold for injection molding of the wobble plate.

19. The pump of claim 16, wherein at least one of an outer first face and an outer second face of the cam include an annular retaining lip, the annular retaining lip abutting a corresponding outer face of the inner race of the bearing, wherein the retaining lip prevents the cam from axial movement with respect to the inner race of the bearing.

* * * * *